US009950206B2

(12) United States Patent
Biddix, Jr.

(10) Patent No.: US 9,950,206 B2
(45) Date of Patent: Apr. 24, 2018

(54) MULTIFUNCTION EXERCISE EQUIPMENT

(71) Applicant: Sarge Fitt LLC, Upper Marlboro, MD (US)

(72) Inventor: Juan Biddix, Jr., Washington, DC (US)

(73) Assignee: SARGE FITT LLC, Upper Marloboro, MD (US)

( * ) Notice: Subject to any disclaimer, the term of this patent is extended or adjusted under 35 U.S.C. 154(b) by 0 days.

(21) Appl. No.: 15/157,990

(22) Filed: May 18, 2016

(65) Prior Publication Data

US 2017/0120099 A1 May 4, 2017

Related U.S. Application Data

(60) Provisional application No. 62/249,763, filed on Nov. 2, 2015.

(51) Int. Cl.
*A63B 26/00* (2006.01)
*A63B 21/00* (2006.01)
(Continued)

(52) U.S. Cl.
CPC ..... *A63B 21/4035* (2015.10); *A63B 17/04* (2013.01); *A63B 21/068* (2013.01); *A63B 23/03525* (2013.01); *A63B 23/1218* (2013.01); *A63B 23/1227* (2013.01); *A63B 23/1236* (2013.01); *A63B 1/00* (2013.01); *A63B 3/00* (2013.01); *A63B 21/0552* (2013.01);
(Continued)

(58) Field of Classification Search
CPC ..... A63B 21/4035; A63B 21/00047; A63B 21/00185; A63B 21/16; A63B 23/03516; A63B 23/0211; A63B 23/1227; A63B 23/1236; A63B 23/1218; A63B 3/00; A63B 1/00
See application file for complete search history.

(56) References Cited

U.S. PATENT DOCUMENTS 3,117,760 A * 1/1964 Dresbach ..... A63B 1/00 248/157
5,013,035 A * 5/1991 Nathaniel ..... A63B 21/16 482/129
(Continued)

OTHER PUBLICATIONS www.bodysolid.com, printed Jan. 9, 2018 (8 pages).
(Continued)

*Primary Examiner* — Loan H Thanh
*Assistant Examiner* — Megan Anderson
(74) *Attorney, Agent, or Firm* — DLA Piper LLP US

(57) ABSTRACT

An embodiment apparatus includes a crossbar including a surface with holes arranged along a portion of the crossbar and a handle including a surface with a hole. The crossbar may be configured to allow the handle to positionally adjust along the portion of the crossbar such that the hole in the surface of the handle aligns with one of the holes in the surface of the crossbar when the handle is located at a position along the portion. Alternatively or in addition, the handle may include a head which defines a plurality of holes in the handle. In this arrangement, a first connector is configured to slidably engage one of the plurality of holes in the handle and the hole in the crossbar, each of the plurality of holes in the first handle defining an orientation of the first handle.

57 Claims, 21 Drawing Sheets

(51) Int. Cl.

| | |
|---|---|
| ***A63B 17/04*** | (2006.01) |
| ***A63B 21/068*** | (2006.01) |
| ***A63B 23/035*** | (2006.01) |
| ***A63B 23/12*** | (2006.01) |
| *A63B 3/00* | (2006.01) |
| *A63B 1/00* | (2006.01) |
| *A63B 21/055* | (2006.01) |
| *A63B 21/16* | (2006.01) |

(52) U.S. Cl.
CPC ..... *A63B 21/16* (2013.01); *A63B 21/4034* (2015.10); *A63B 21/4043* (2015.10); *A63B 2225/09* (2013.01); *A63B 2225/093* (2013.01)

(56) References Cited

U.S. PATENT DOCUMENTS 5,205,802 A * 4/1993 Swisher ..... A63B 21/00047 482/100
5,306,220 A * 4/1994 Kearney ..... A63B 23/00 482/104
6,186,930 B1 * 2/2001 Ignaczak ..... A63B 23/12 482/141
7,717,837 B2 * 5/2010 Florczak ..... A63B 1/00 482/143
7,896,786 B1 * 3/2011 Osbourne ..... A63B 21/0552 482/122
8,177,694 B1 * 5/2012 Walker ..... A63B 1/00 482/126
9,409,048 B1 * 8/2016 Hopperstad ..... A63B 21/078
9,498,664 B2 * 11/2016 Lorentz, II ..... A63B 21/00047
2010/0190612 A1 * 7/2010 Cook ..... A63B 71/023 482/38
2013/0345026 A1 * 12/2013 Eberflus ..... A63B 1/00 482/38
2015/0016919 A1 * 1/2015 Tambornino ..... F16B 35/06 411/366.1

OTHER PUBLICATIONS www.elitefts.com, retrieved from www.web.archive.org, archived Aug. 1, 2015, printed Jan. 9, 2018 (8 pages).
www.fringesport.com, retrieved from www.web.archive.org, archived Oct. 26, 2015, printed Jan. 9, 2018 (33 pages).
www.ironcompany.com, retrieved from www.web.archive.org, archived Oct. 23, 2015, printed Jan. 8, 2018 (15 pages).
www.repfitness.com, retrieved from www.web.archive.org, archived Oct. 26, 2015, printed Jan. 8, 2018 (7 pages).
www.roguefitness.com, retrieved from www.web.archive.org, archived Oct. 31, 2015, printed Jan. 9, 2018 (101 pages).
www.solostrength.com, retrieved from www.web.archive.org, archived Oct. 13, 2015, printed Jan. 9, 2018 (14 pages).
www.staminaproducts.com, retrieved from www.web.archive.org, archived Oct. 19, 2015, printed Jan. 9, 2018 (38 pages).
www.steelfitstrength.com, retrieved from www.web.archive.org, archived Oct. 17, 2015, printed Jan. 8, 2018 (7 pages).
www.tacticalathlete.com, retrieved from www.web.archive.org, archived Oct. 30, 2015, printed Jan. 8, 2018 (12 pages).
www.titandistributorsinc.com, retrieved from www.web.archive.org, archived Oct. 30, 2015, printed Jan. 8, 2018 (5 pages).
www.trapezerigging.corn, retrieved from www.web.archive.org, archived Oct. 13, 2015, printed Jan. 9, 2018 (34 pages).
Stamina Outdoor Fitness Power Tower Owner's Manual, Stamina Products, Inc., Copyright 2015 (19 pages).
Stamina PT 1690 Owner's Manual, Stamina Products, Inc., Copyright 2012 (18 pages).

* cited by examiner

MULTIFUNCTION EXERCISE EQUIPMENT

CROSS-REFERENCE TO RELATED APPLICATIONS

This application claims the benefit of U.S. Provisional Application No. 62/249,763, filed Nov. 2, 2015, entitled "Multifunction Exercise Equipment," which is hereby incorporated by reference in its entirety.

DETAILED DESCRIPTION OF EMBODIMENTS

Embodiments described herein provide multifunction exercise equipment which allows a user to perform a variety of exercises.

Figure 1:
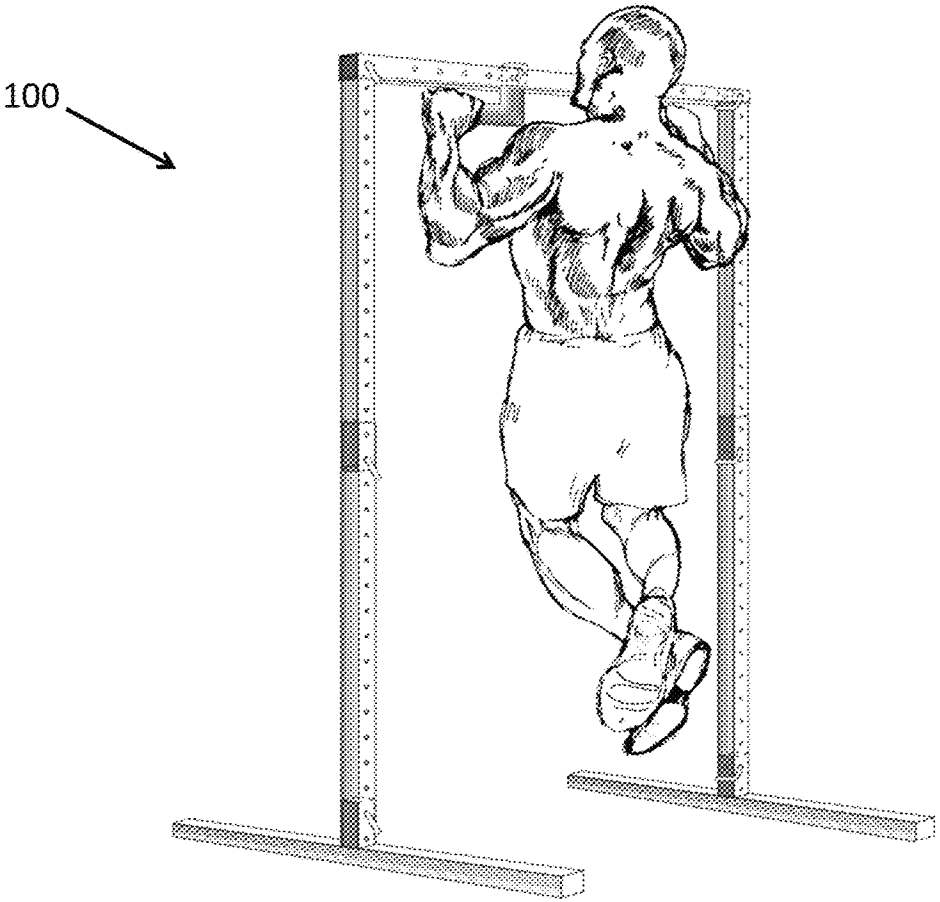
FIG. 1 is a perspective view of multifunction exercise equipment as per an aspect of an embodiment of the present invention.

FIG. 1 is a perspective view of multifunction exercise equipment 100 as per an aspect of an embodiment of the present invention. A user may perform a variety of exercises in conjunction with multifunction exercise equipment 100. For example, a user may use multifunction exercise equipment 100 to do pull-up exercises as shown in FIG. 1. A user may use multifunction exercise equipment 100 to perform a variety of exercises, including leg raises, leg tuck and twists, straight arm pulls, flexed arm hangs, alternating grip pull-ups, shoulder stretches, and back stretches, among others.

Figure 2:
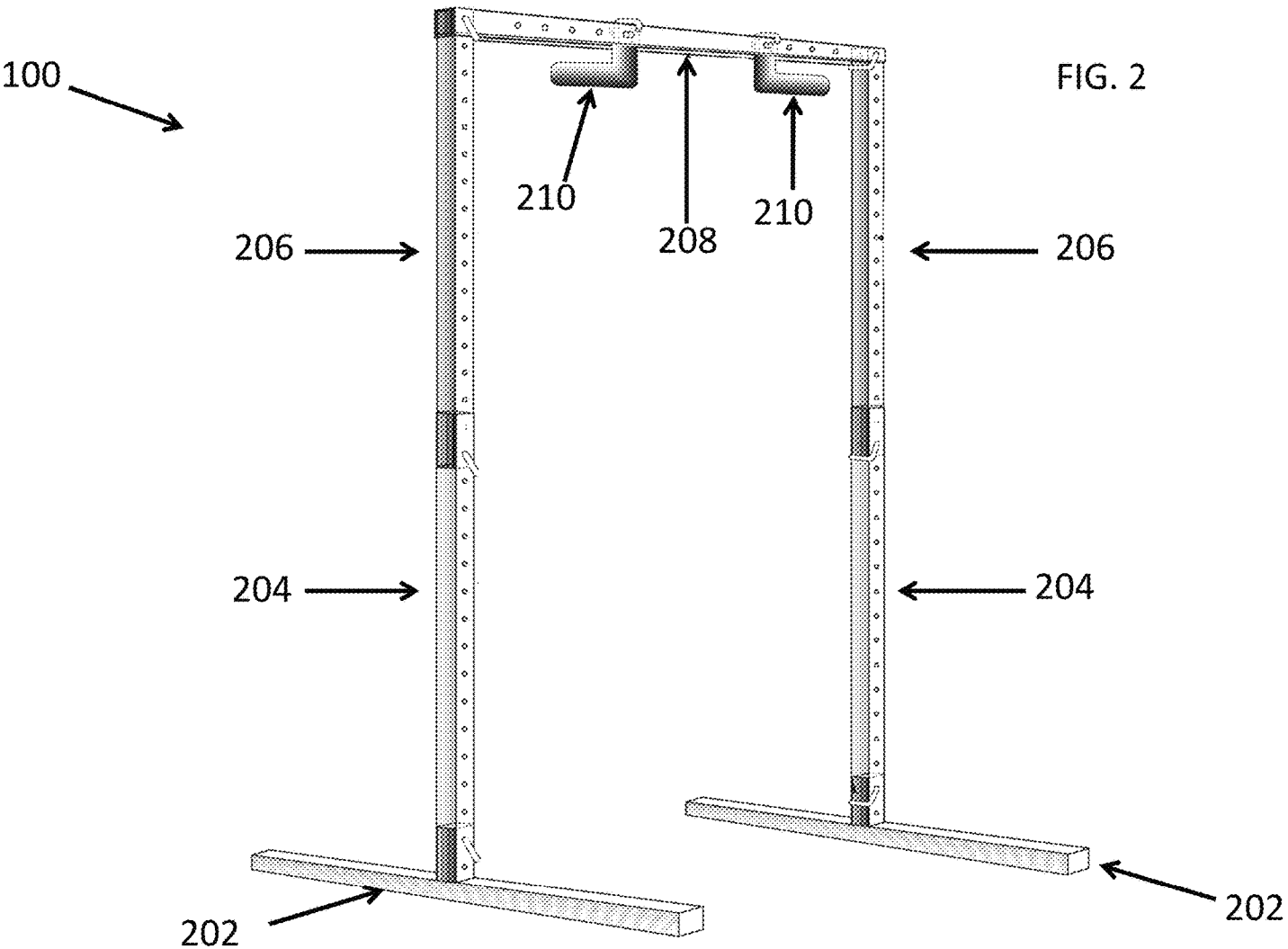
FIG. 2 is a perspective view of multifunction exercise equipment as per an aspect of an embodiment of the present invention.

FIG. 2 is a perspective view of multifunction exercise equipment 100 as per an aspect of an embodiment of the present invention. Multifunction exercise equipment 100 may comprise first and second bases 202 which stabilize the multifunction exercise equipment 100. The first base 202 may be configured to slidably engage the first portion 204 of a first leg, and the second base 202 is configured to slidably engage the first portion 204 of a second leg. The second portion 206 of the first leg may be configured to slidably engage the first portion 204 of the first leg, and the second portion 206 of the second leg may be configured to slidably engage the first portion 204 of the second leg. A first end portion of the crossbar 208 may be configured to slidably engage the second portion 206 of the first leg, and a second end portion of the crossbar 208 may be configured to slidably engage the second portion 206 of the second leg. Handles 210 may be connected to the crossbar 208.

Elements of the multifunction exercise equipment, such as the base, first and second portions, crossbar, and/or handles, may comprise any suitable material, such as gauge steel, high grade aluminum, high grade plastic, iron and/or other types of steel. In an embodiment, a powder coat finish may be applied to elements of the multifunction exercise equipment by any means known in the art. In an embodiment, the powder coat finish may be applied electrostatically by charging the powder particles and applying them directly to an element of the surface of the multifunction exercise equipment. The element may be grounded, thereby causing the charged particles to adhere to the surface. In an embodiment, the element comprising charged particles may be cured, for example via a curing oven, resulting in a uniform and durable finish. In an embodiment, one or both handles may comprise a plastic, foam, or rubber sleeve to facilitate the user's grip. Alternatively, the handles may comprise no sleeve.

Figure 3:
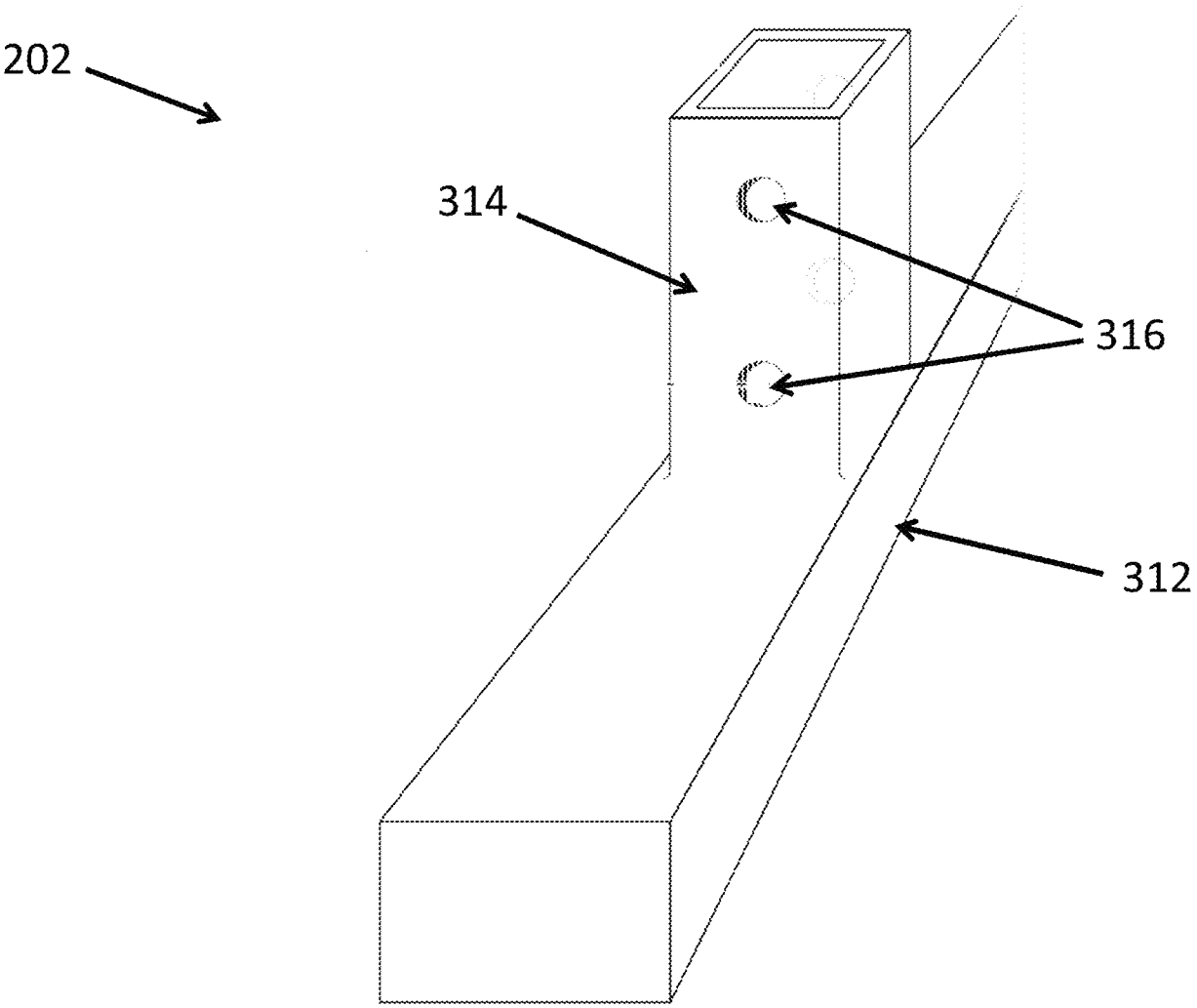
FIG. 3 is a partial view of multifunction exercise equipment as per an aspect of an embodiment of the present invention.

FIG. 3 is a partial view of multifunction exercise equipment as per an aspect of an embodiment of the present invention. In particular, FIG. 3 illustrates a base 202, such as the first or second base 202 shown in FIG. 2. Base 202 may comprise a base leg 312, which may provide a foundation for multifunction exercise equipment. Base leg 312 may run parallel to the surface upon which base leg 312 rests. Base 202 may further comprise base extension 314, which may be configured to slidably engage a portion of a leg, such as the first portion 204 of the first or second leg as shown in FIG. 2. Base extension 314 may comprise a surface defining a first hole 316 which is proximal to the base leg 312 and a second hole 316 which is distal from the base leg 312. Base extension 314 may further comprise a surface defining holes which are oppositely aligned from first and second holes 316.

Figure 4:
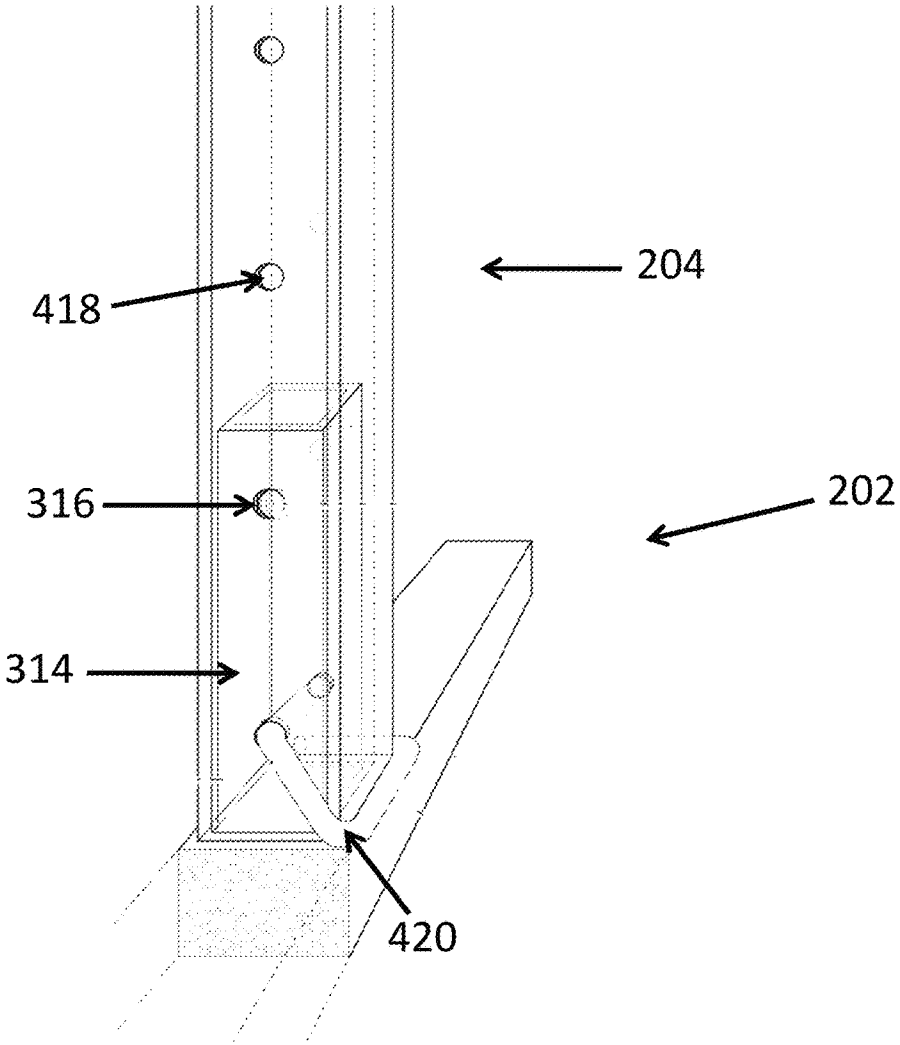
FIG. 4 is a partial view of multifunction exercise equipment as per an aspect of an embodiment of the present invention.

FIG. 4 is a partial view of multifunction exercise equipment as per an aspect of an embodiment of the present invention. In particular, FIG. 4 illustrates how the base 202 may be configured to slidably engage the first portion 204 of the first or second leg. Although FIG. 4 illustrates a portion of the first portion 204 as slid over the base extension 314, any suitable configuration may be utilized. For instance, in an embodiment, a first portion of a first or second leg may be slid into a base extension. The first portion 204 of the first or second legs may comprise a surface defining holes 418. The first portion 204 may further comprise a surface defining holes which are oppositely aligned from holes 418.

The first portion 204 may comprise a hollow columnar structure which defines a space for the base extension 314. The base extension 314 may be slidably engaged with the first portion 204 such that holes 316 align with holes 418. A connector, such as pin 420, may pass through one of the holes 316, one of the holes 418, and the holes which are oppositely aligned therefrom. Pin 420 may thus secure the first portion 204 of the first or second leg to the first or second base 202.

Figure 5:
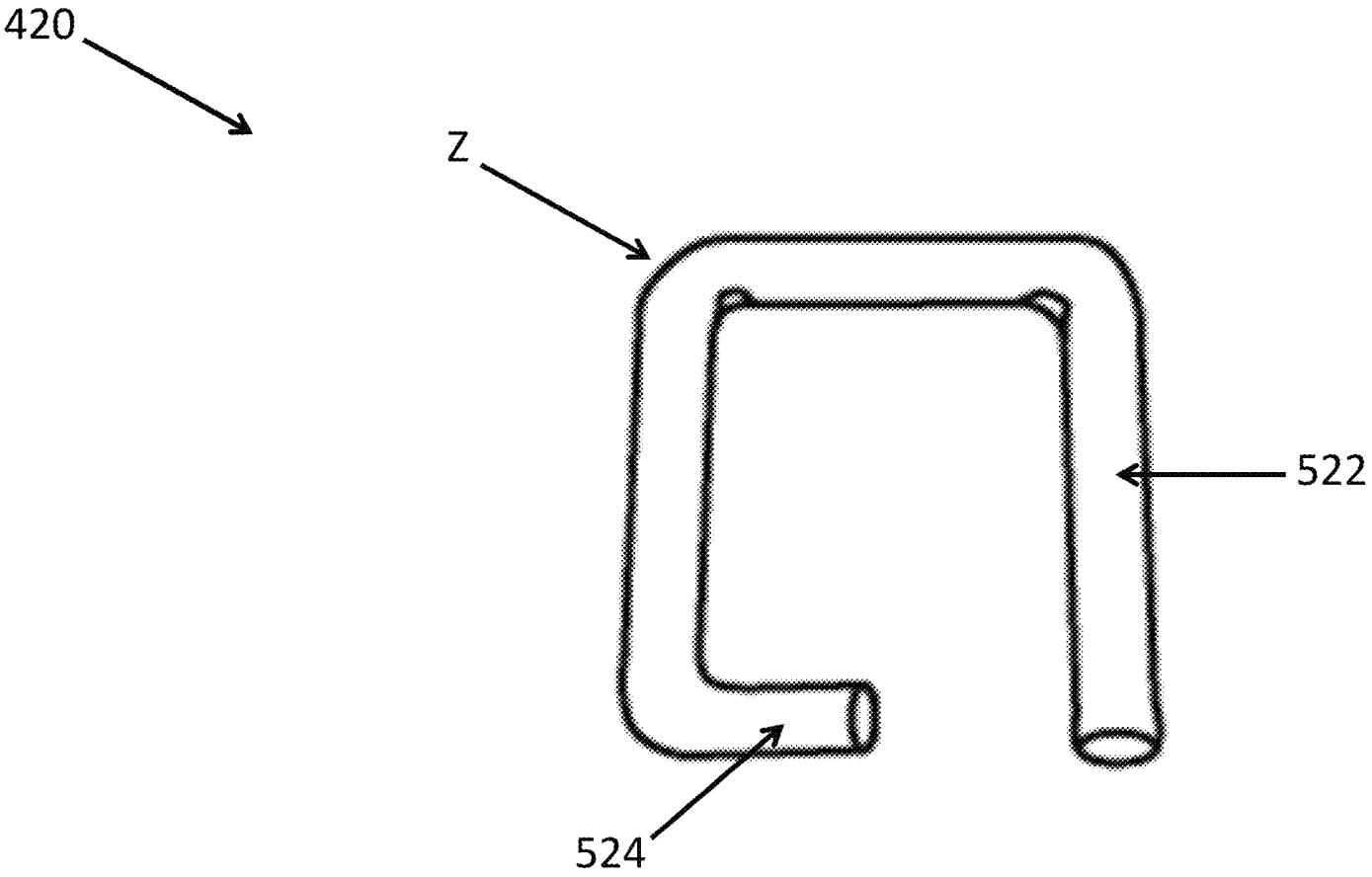
FIG. 5 is a perspective view of a pin as per an aspect of an embodiment of the present invention.

FIG. 5 is a perspective view of a pin 420 as per an aspect of an embodiment of the present invention. The pin 420 may comprise a pin leg 522 and a pin hook 524. The pin leg may be the portion of the pin 420 which passes through holes, such as holes 316, 418 as illustrated in FIG. 4. The pin hook 524 may wrap around the structure defining the hole (e.g., the first portion 420 of the first or second leg), thereby securing the pin leg 522 in any holes through which it passes. The pin may be angled at corner Z such that pin leg 522 is in a different plane than pin hook 524. The pin may be angled as such to allow a user to insert the pin leg 522 into a hole without the pin hook 524 interfering with the structure. Although FIG. 5 illustrates a pin 420, any suitable connector, including a straight pin, nuts and bolts, and/or a j-hook, may be utilized.

Figure 6:
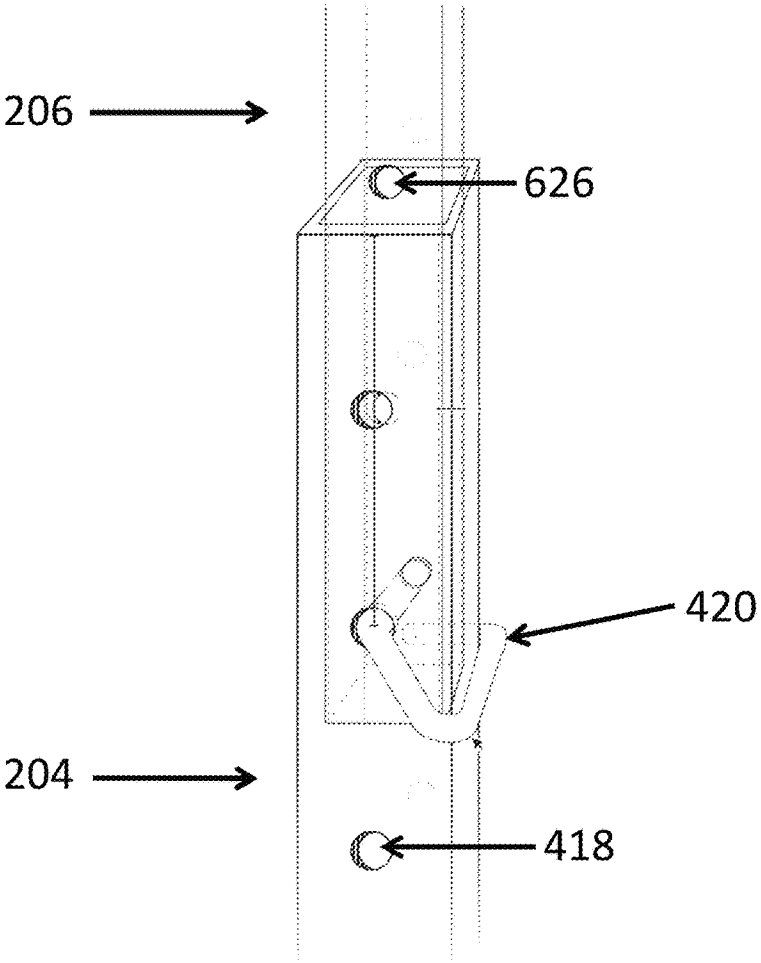
FIG. 6 is a partial view of multifunction exercise equipment as per an aspect of an embodiment of the present invention.

FIG. 6 is a partial view of multifunction exercise equipment as per an aspect of an embodiment of the present invention. In particular, FIG. 6 illustrates how the first portion 204 of the first or second legs may be configured to slidably engage the second portion 206 of the first or second legs. The first portion 204 of the first or second legs comprises a surface defining holes 418. The first portion 204 may further comprise a surface defining holes which are oppositely aligned from holes 418. Similarly, the second portion 206 of the first or second legs may comprise a surface defining holes 626. The first portion 206 may further comprise a surface defining holes which are oppositely aligned from holes 626.

The first portion 204 may comprise a hollow columnar structure which defines a space for the second portion 206. The second portion 206 may be slidably engaged with the first portion 204 such that holes 626 align with holes 418. Although FIG. 6 illustrates a portion of the first portion 204 as slid over the second portion 206, any suitable configuration may be utilized. For instance, in an embodiment, a first portion of a first or second leg may be slid into a second portion of a first or second leg. A connector, such as pin 420, may pass through one of the holes 626, one of the holes 418, and the holes which are oppositely aligned therefrom. Pin 420 may thus secure the first portion 204 of the first or second leg to the second portion 206 of the first or second leg.

Figure 7:
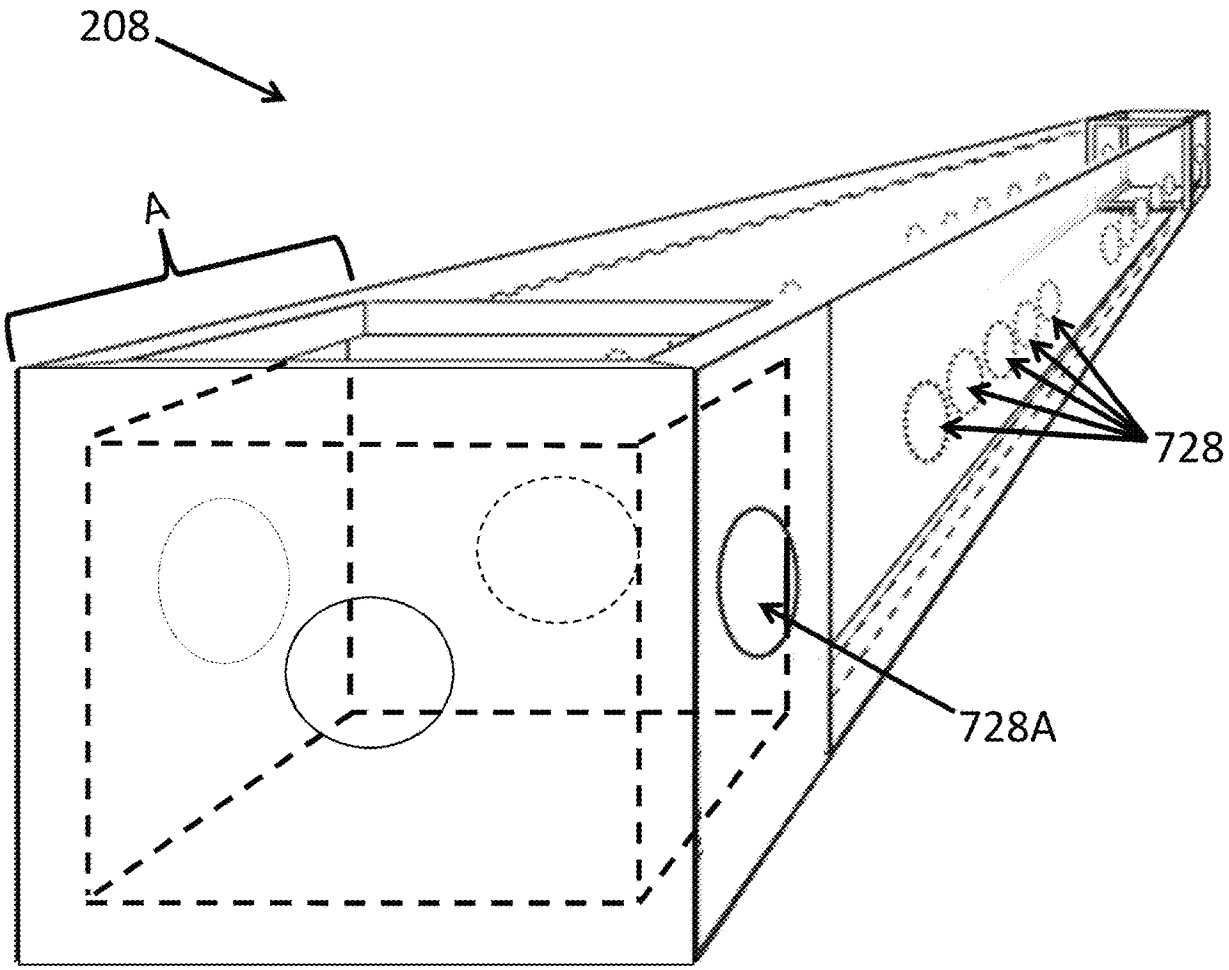
FIG. 7 is a partial view of multifunction exercise equipment as per an aspect of an embodiment of the present invention.

FIG. 7 is a partial view of multifunction exercise equipment as per an aspect of an embodiment of the present invention. In particular, FIG. 7 illustrates the crossbar 208. Crossbar 208 may comprise a section A which is configured to slidably engage with the second portion of the first or second leg, such as second portion 206 as shown in FIG. 2. The section A may comprise a surface defining holes 728A and holes oppositely aligned therefrom. The crossbar 208 may further comprise a surface which defines holes 728 and holes oppositely aligned therefrom.

Figure 8:
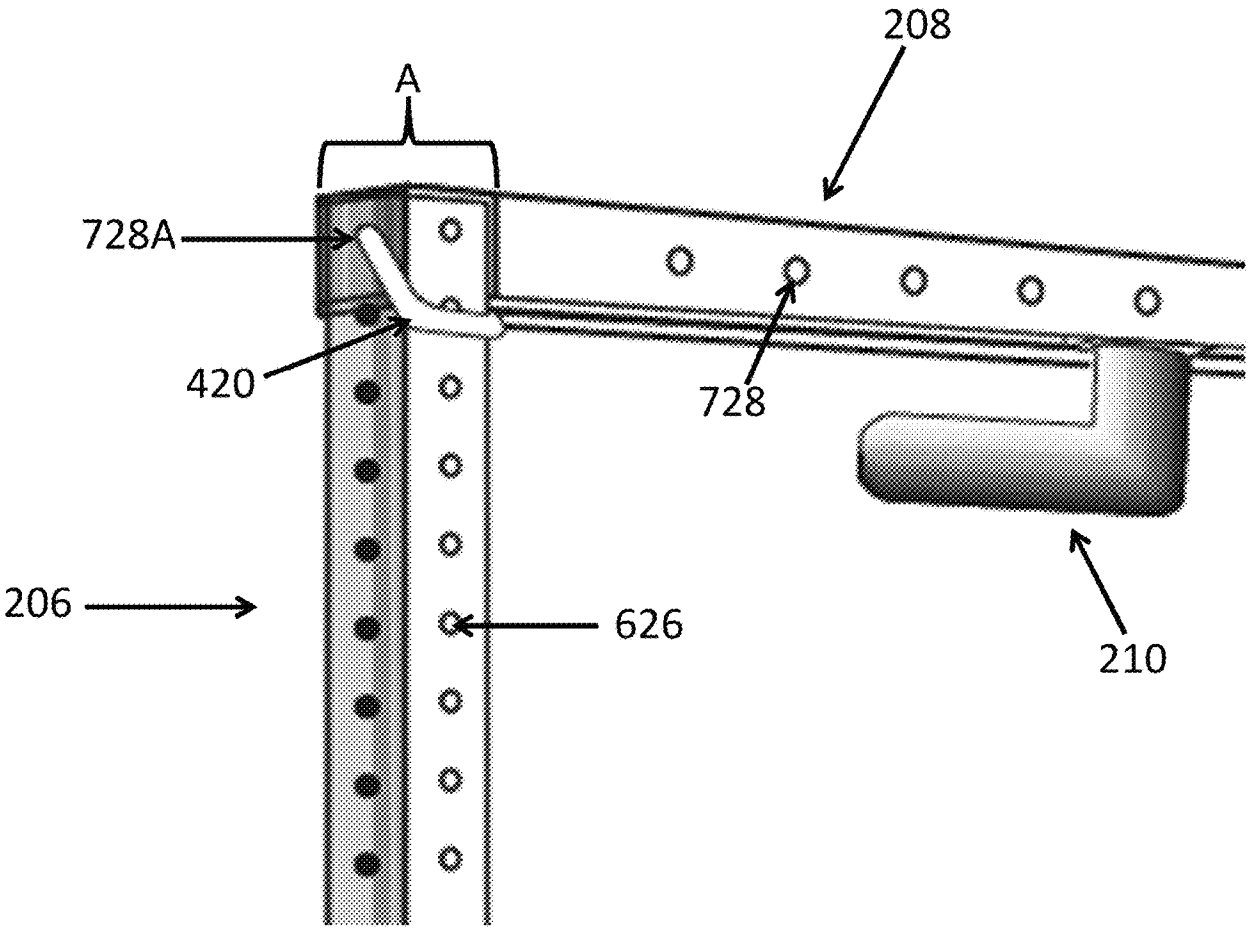
FIG. 8 is a partial view of multifunction exercise equipment as per an aspect of an embodiment of the present invention.

FIG. 8 is a partial view of multifunction exercise equipment as per an aspect of an embodiment of the present invention. In particular, FIG. 8 illustrates how the crossbar 208 may be configured to slidably engage the second portion 206 of the first or second legs. The crossbar 208 may comprise a surface defining holes 728A. The crossbar 208 may further comprise a surface defining holes which are oppositely aligned from holes 728A. Similarly, the second portion 206 of the first or second legs may comprise a surface defining holes 626. The first portion 206 may further comprise a surface defining holes which are oppositely aligned from holes 626.

The crossbar 208 may comprise a hollow columnar structure which defines a space for the second portion 206. The second portion 206 may be slidably engaged with the crossbar 208 such that holes 626 align with holes 728A. A connector, such as pin 420, may pass through one of the holes 626, one of the holes 728A, and the holes which are oppositely aligned therefrom. Pin 420 may thus secures the crossbar 208 to the second portion 206 of the first or second leg. As will be explained in greater detail, handle 210 may be secured to the crossbar 208 via one of the holes 728. Although the base extension, first and second portions, and crossbar are illustrated as defining two opposing rows of holes, one of ordinary skill will recognize other configurations are possible. For example, in an embodiment, the base extension, first and second portions, and/or crossbar define four rows of holes, wherein one row is located on each side of the base extension, first and second portions, and/or crossbar.

Figure 9:
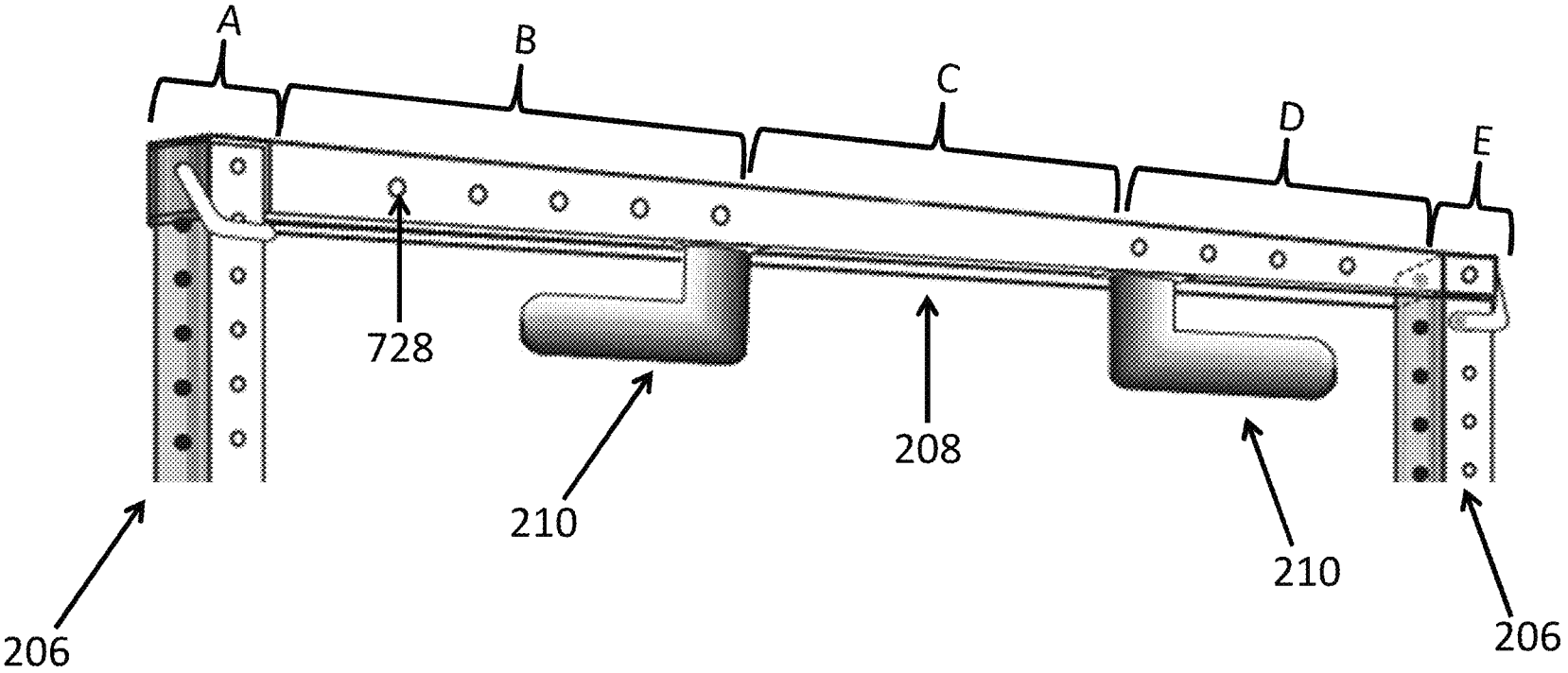
FIG. 9 is a partial view of multifunction exercise equipment as per an aspect of an embodiment of the present invention.

FIG. 9 is a partial view of multifunction exercise equipment as per an aspect of an embodiment of the present invention. In particular, FIG. 9 illustrates the slidability of handles 210 in crossbar 208. The crossbar 208 may comprise sections A-E. Sections A and E may be configured to slidably engage second portions 206 of the first and second legs, as described in greater detail in the description corresponding to FIGS. 7-8.

Sections B and D may both comprise surfaces which define holes 728 and holes which are oppositely aligned therefrom. FIG. 9 illustrates five holes in each of sections B and D, but any number of holes 728 may be utilized. Sections B and D may comprise a hollow structure which defines a space for the first and second handles 210. The handles 210 may be slidably engaged with sections B and D, respectively, such that the handles 210 may be fixed to any of holes 728 along of the crossbar 208.

Crossbar 208 may be configured to allow a first handle 210 to positionally adjust along section B such that a hole (not shown) in the surface of the first handle 210 aligns with one of holes 728. A connector (not shown) may pass through a hole in the surface of the first handle 210, one of the holes

728, and the holes which are oppositely aligned therefrom. The first handle 210 may thus be secured at a particular position along the crossbar 208 in section B. Although FIG. 9 shows the first handle 210 as located at the rightmost hole in section B, the first handle 210 may be fixed to any hole 728 at any position along the crossbar 208 in section B.

Similarly, crossbar 208 may be configured to allow a second handle 210 to positionally adjust along section D such that a hole (not shown) in the surface of the second handle 210 aligns with one of holes 728. A connector (not shown) may pass through a hole in the surface of the second handle 210, one of the holes 728, and the holes which are oppositely aligned therefrom. The second handle 210 may thus be secured at a particular position along the crossbar 208 in section D. Although FIG. 9 shows the second handle 210 as located at the leftmost hole in section D, the first handle 210 may be fixed to any hole 728 at any position along the crossbar 208 in section D.

In a non-limiting embodiment, crossbar 208 may be configured to prevent first and second handles 210 from sliding in section C. For example, section C may be solid, thereby obstructing the handles 210 from sliding into section C from sections B or D. In an embodiment, section C may be hollow such that the handles 210 may slide along section C.

Figure 10:
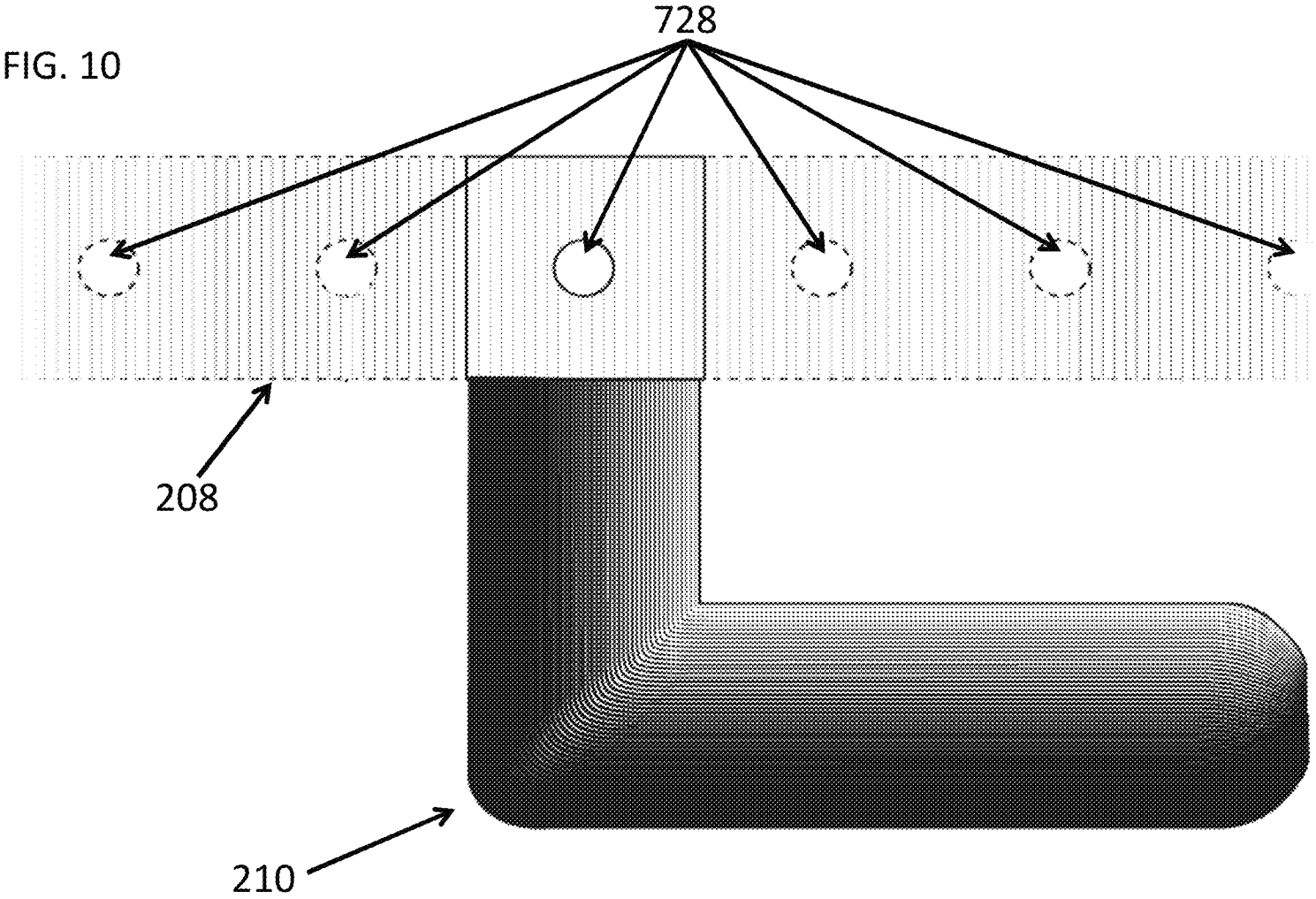
FIG. 10 is a partial view of multifunction exercise equipment as per an aspect of an embodiment of the present invention.

FIG. 10 is a partial view of multifunction exercise equipment as per an aspect of an embodiment of the present invention. In particular, FIG. 10 illustrates the slidability of a first or second handle 210 in crossbar 208. For instance, the section of the crossbar 208 shown in FIG. 10 may be section B or section D as illustrated in FIG. 9.

Crossbar 208 may be configured to allow a handle 210 to positionally adjust along the crossbar 208 such that a hole (not shown) in the surface of the handle 210 aligns with one of holes 728. A connector (not shown) may pass through a hole in the surface of the handle 210, one of the holes 728, and the holes which are oppositely aligned therefrom. The handle 210 may thus be secured at a particular position along the crossbar 208. The handle 210 may be fixed to any hole 728 at any position along the crossbar 208.

Figure 11:
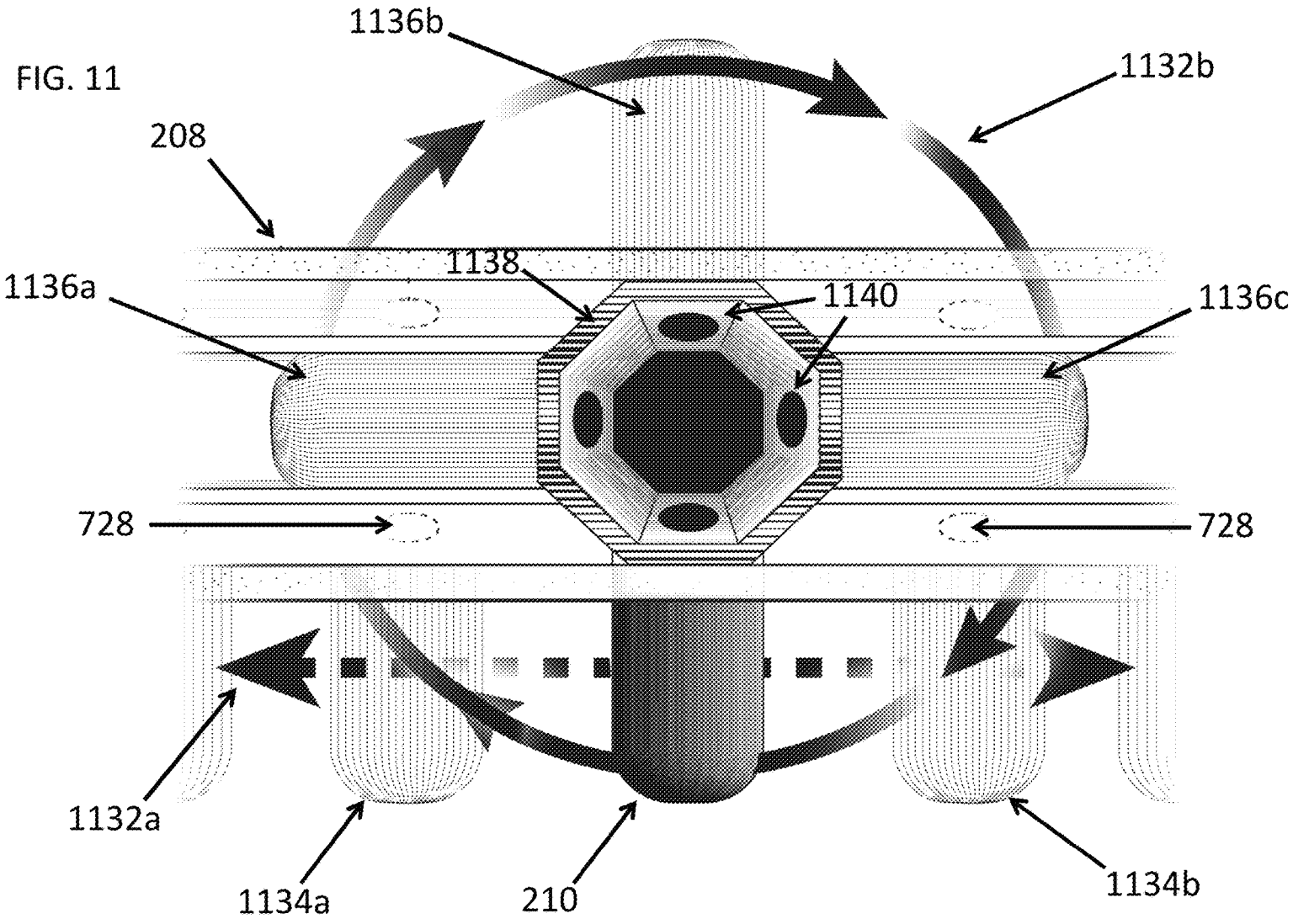
FIG. 11 is a partial view of multifunction exercise equipment as per an aspect of an embodiment of the present invention.

FIG. 11 is a partial view of multifunction exercise equipment as per an aspect of an embodiment of the present invention. In particular, FIG. 11 illustrates the slidability and orientability of handle 210 in crossbar 208. The handle 210 may comprise a surface 1138 defining holes 1140. The first handle 210 may further comprise a head which comprises a surface 1138 defining holes which are oppositely aligned from holes 1140. Similarly, the crossbar 208 may comprise a surface defining holes 728. The crossbar 208 may further comprise a surface defining holes which are oppositely aligned from holes 728.

In an embodiment, the handle 210 may be slidable along the crossbar 208. For instance, handle 210 may be positioned at positions 1134*a* or 1134*b*. If position 1134*a* is desired, handle 210 may slide to the left of handle 210 as illustrated by arrow 1132*a*. If position 1134*b* is desired, handle 210 may slide to the right of handle 210, as illustrated by arrow 1132*b*. The handle 210 may be slidable at any orientation (i.e., regardless of the orientation of the handle relative to the crossbar 208).

Crossbar 208 may comprise a first wall and a second wall parallel to the first wall. The crossbar 208 may further comprise lips protruding toward each other, forming a track. The crossbar 208 may thus be configured to allow the handle 210 to slide along the track formed by the lips of the crossbar 208 as illustrated by arrows 1132*a*. The handle 210 may positionally adjust to a given position along the crossbar 208. When one of holes 1140 aligns with one of holes 728, a connector (not shown) may pass through one of the holes 1140, one of the holes 728, and the holes which are oppositely aligned therefrom. The handle 210 may thus be secured to a position along the crossbar 208.

Although one or more handles may be adjusted and/or connected to a crossbar as described above, one or more handles may be connected in any suitable manner. For example, rather than positionally adjusting a handle by sliding the handle along a track formed by lips of the crossbar, a handle may be positionally adjusted along a crossbar by detachment and re-attachment. For example, the crossbar may not comprise the track such that a handle may be completely removed from the crossbar, for example by removing a connector and pulling the handle out of the crossbar. In an embodiment, the handle may be inserted into another position along the crossbar and re-attached to the crossbar via a connector. In an embodiment, the crossbar may comprise hollow portions to accept the handles in particular positions along the crossbar and may further comprise solid portions elsewhere. In an embodiment, the handles may attach to the crossbar by means other than a connector. For example, the handles may screw into the crossbar via holes at various positions along the crossbar.

In an embodiment, the handle 210 may be orientable with respect to the crossbar 208. For instance, handle 210 may be rotated to orientation 1136*a*, 1136*b*, or 1136*c*. If orientation 1136*a* is desired, handle 210 may be rotated 90 degrees along the direction of the arrow 1132*b*. If orientation 1136*b* is desired, handle 210 may be rotated 180 degrees along the direction of the arrow 1132*b*. If orientation 1136*c* is desired, handle 210 may be rotated 270 degrees along the direction of the arrow 1132*b*. The handle 210 may be orientable at any position along the crossbar 208 (i.e., regardless of the hole 728 to which handle 210 is affixed).

In an embodiment, the surface 1138 of the handle 210 may define an octagonal columnar structure. In an embodiment, the first and second walls may be sufficiently mutually distant that the handle 210 has room to rotate within the crossbar 208. In an embodiment, the first and second walls may not be sufficiently mutually distant, such that the handle 210 does not have room to rotate within the crossbar 208. In this embodiment, the handle 210 may be partially removed from the crossbar 208 such that the grip of the handle 210 remains below the crossbar 208 but the head of the handle 210 is raised above the walls of the crossbar 208. In this embodiment, the handle 210 may be rotated while the head remains above the crossbar 208. In this embodiment, the handle 210 may be lowered into the crossbar 208 after being properly oriented. When one of holes 1140 aligns with one of holes 728, a connector (not shown) may pass through one of the holes 1140, one of the holes 728, and the holes which are oppositely aligned therefrom. The handle 210 may thus be oriented relative to the crossbar 208.

The surface of the handle may define a structure other than an octagonal columnar structure, such as any structure capable of accommodating oppositely aligned holes. For example, the handle may define a circular or square columnar structure.

Figure 12:
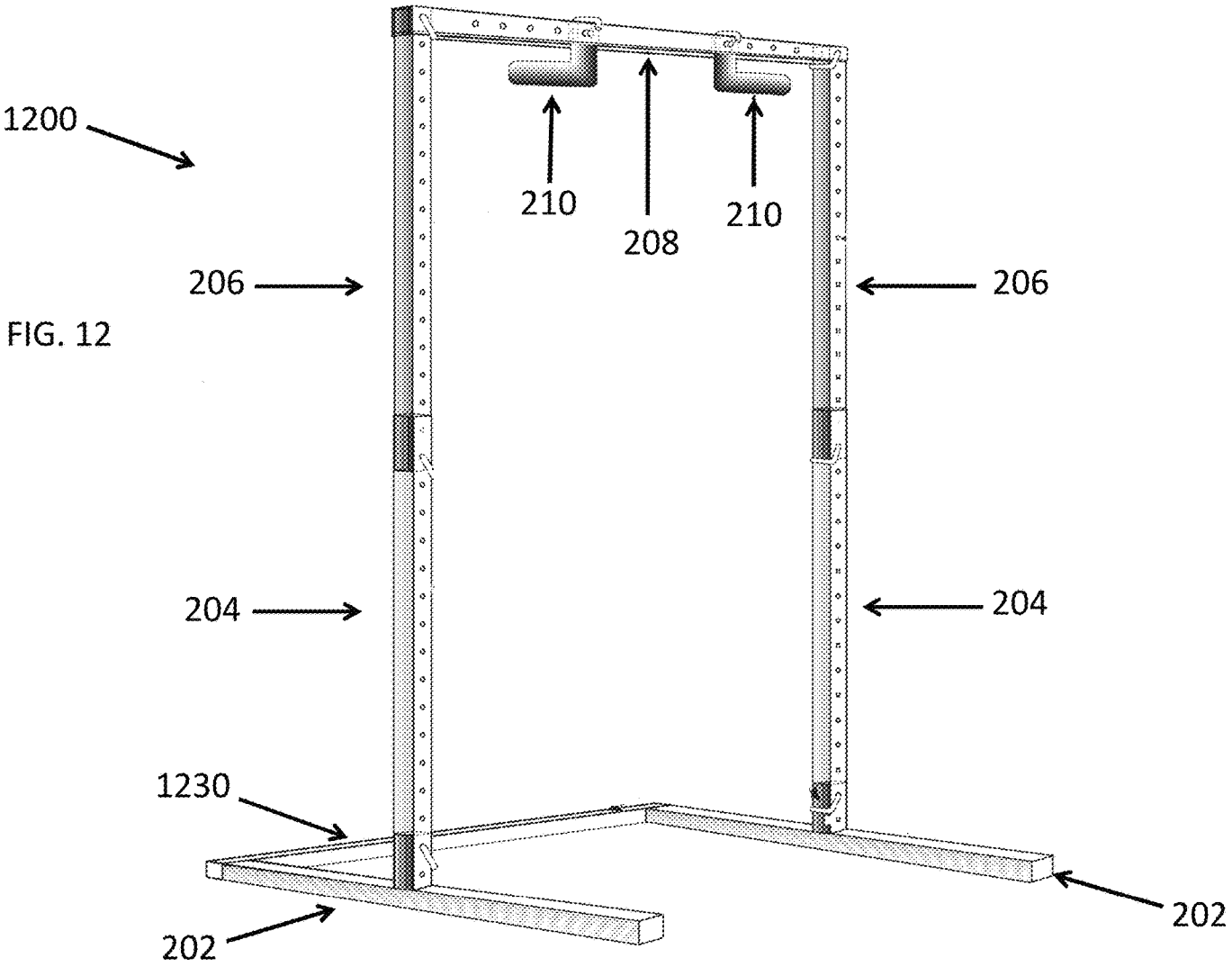
FIG. 12 is a perspective view of multifunction exercise equipment as per an aspect of an embodiment of the present invention.

FIG. 12 is a perspective view of multifunction exercise equipment 1200 as per an aspect of an embodiment of the present invention. Multifunction exercise equipment 1200 may comprise first and second bases 202, and may further comprises a stabilizer bar 1230 connecting the first and second bases. The bases 202 and stabilizer bar 1230 may stabilize the multifunction exercise equipment 1200. The first base 202 may be configured to slidably engage the first portion 204 of the first leg, and the second base 202 may be configured to slidably engage the first portion 204 of the second leg. The second portion 206 of the first leg may be configured to slidably engage the first portion 204 of the first leg, and the second portion 206 of the second leg may be configured to slidably engage the first portion 204 of the second leg. A first end portion of the crossbar 208 may be configured to slidably engage the second portion 206 of the first leg, and a second end portion of the crossbar 208 may be configured to slidably engage the second portion 206 of the second leg. Handles 210 may be connected to the crossbar 208.

Figure 13:
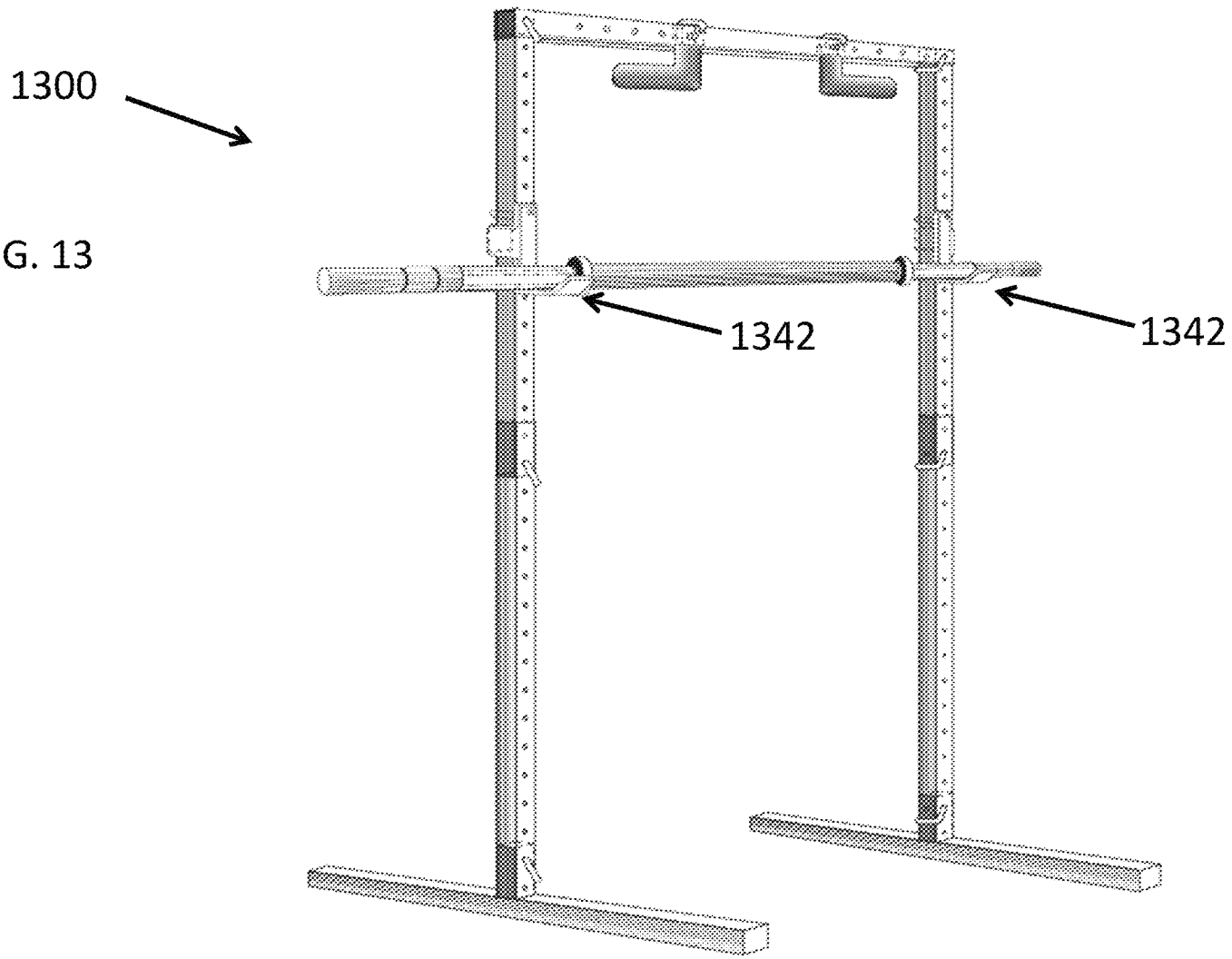
FIG. 13 is a perspective view of multifunction exercise equipment as per an aspect of an embodiment of the present invention.

FIG. 13 is a perspective view of multifunction exercise equipment 1300 as per an aspect of an embodiment of the present invention. Multifunction exercise equipment 1300 may be capable of providing a weight bar. In an embodiment, the weight bar may be suspended by j-hooks 1342.

Figure 14:
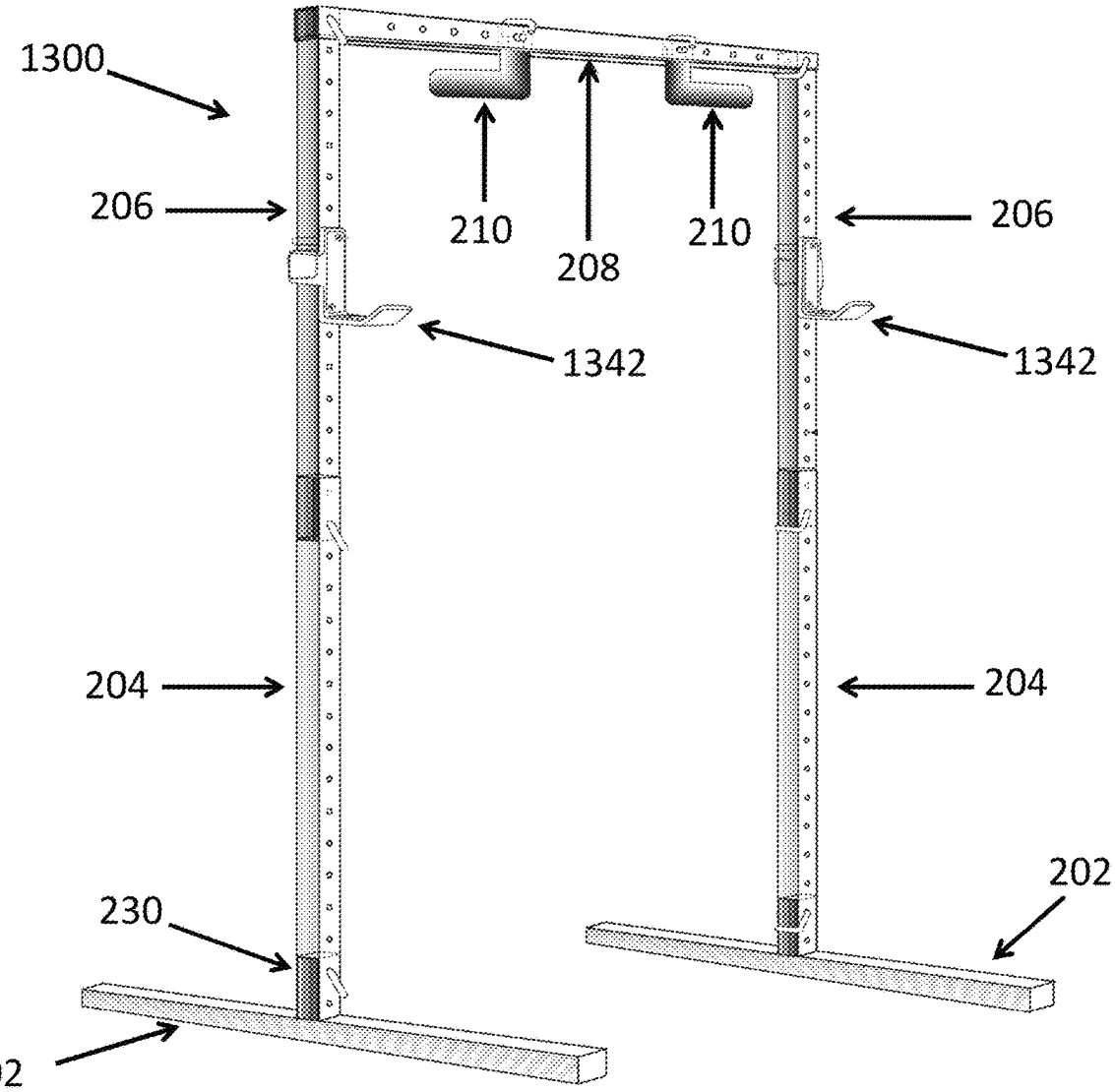
FIG. 14 is a perspective view of multifunction exercise equipment as per an aspect of an embodiment of the present invention.

FIG. 14 is a perspective view of multifunction exercise equipment 1300 as per an aspect of an embodiment of the present invention. Multifunction exercise equipment 1300 may comprise first and second bases 202 which stabilize the multifunction exercise equipment 100. The first base 202 may be configured to slidably engage the first portion 204 of the first leg, and the second base 202 may be configured to slidably engage the first portion 204 of the second leg. The second portion 206 of the first leg may be configured to slidably engage the first portion 204 of the first leg, and the second portion 206 of the second leg may be configured to slidably engage the first portion 204 of the second leg. A first j-hook 1342 may be secured to a second portion 206 of the first leg, and a second j-hook 1342 may be secured to a second portion 206 of the second leg. In an embodiment, j-hooks may be inserted into the first portions 204 of the first and second legs. The j-hooks 1342 may be secured by any means known in the art. The j-hooks 1342 may be secured at the same vertical height such that a weight bar, when placed on the j-hooks 1342, is level. A first end portion of the crossbar 208 may be configured to slidably engage the second portion 206 of the first leg, and a second end portion of the crossbar 208 may be configured to slidably engage the second portion 206 of the second leg. Handles 210 may be connected to the crossbar 208.

Figure 15:
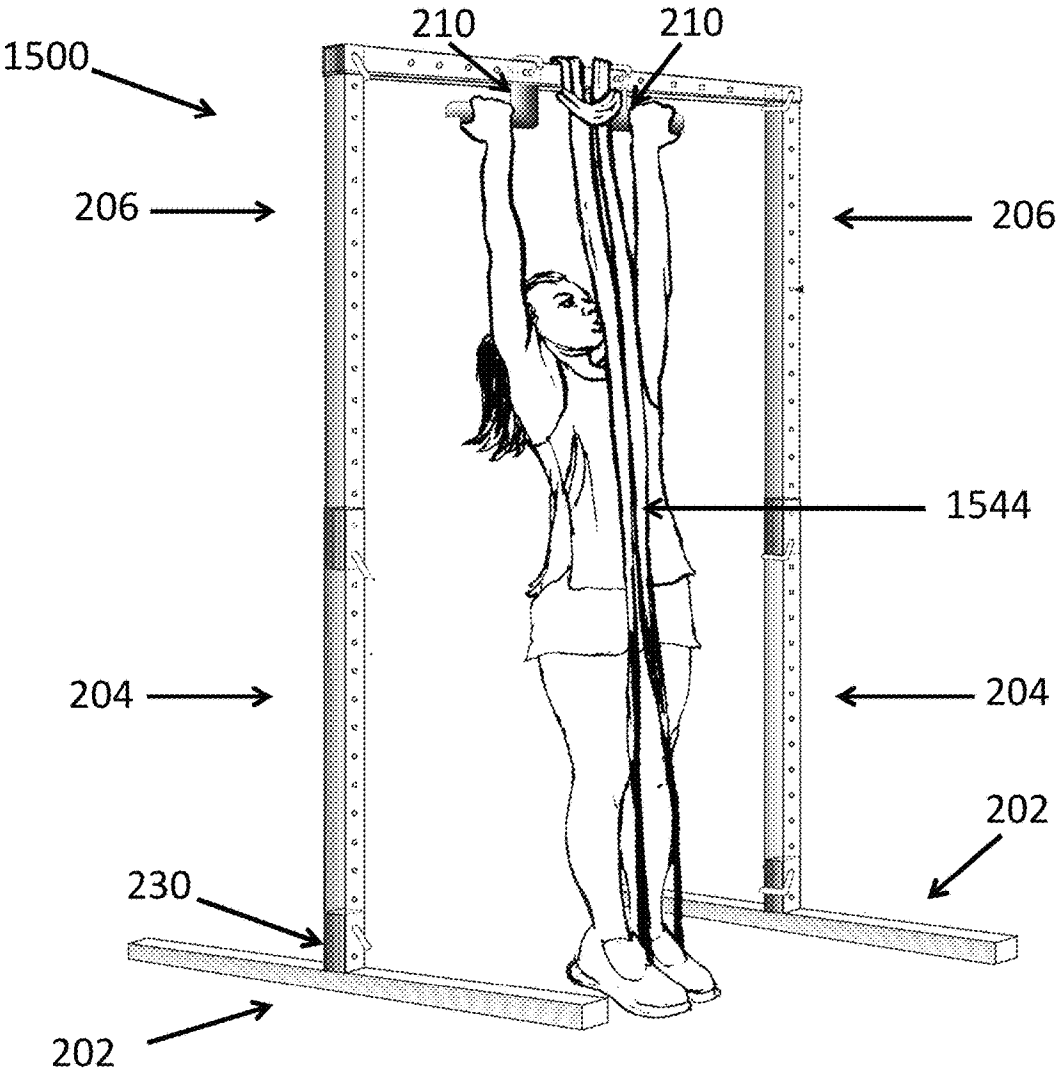
FIG. 15 is a perspective view of multifunction exercise equipment as per an aspect of an embodiment of the present invention.
Figure 16:
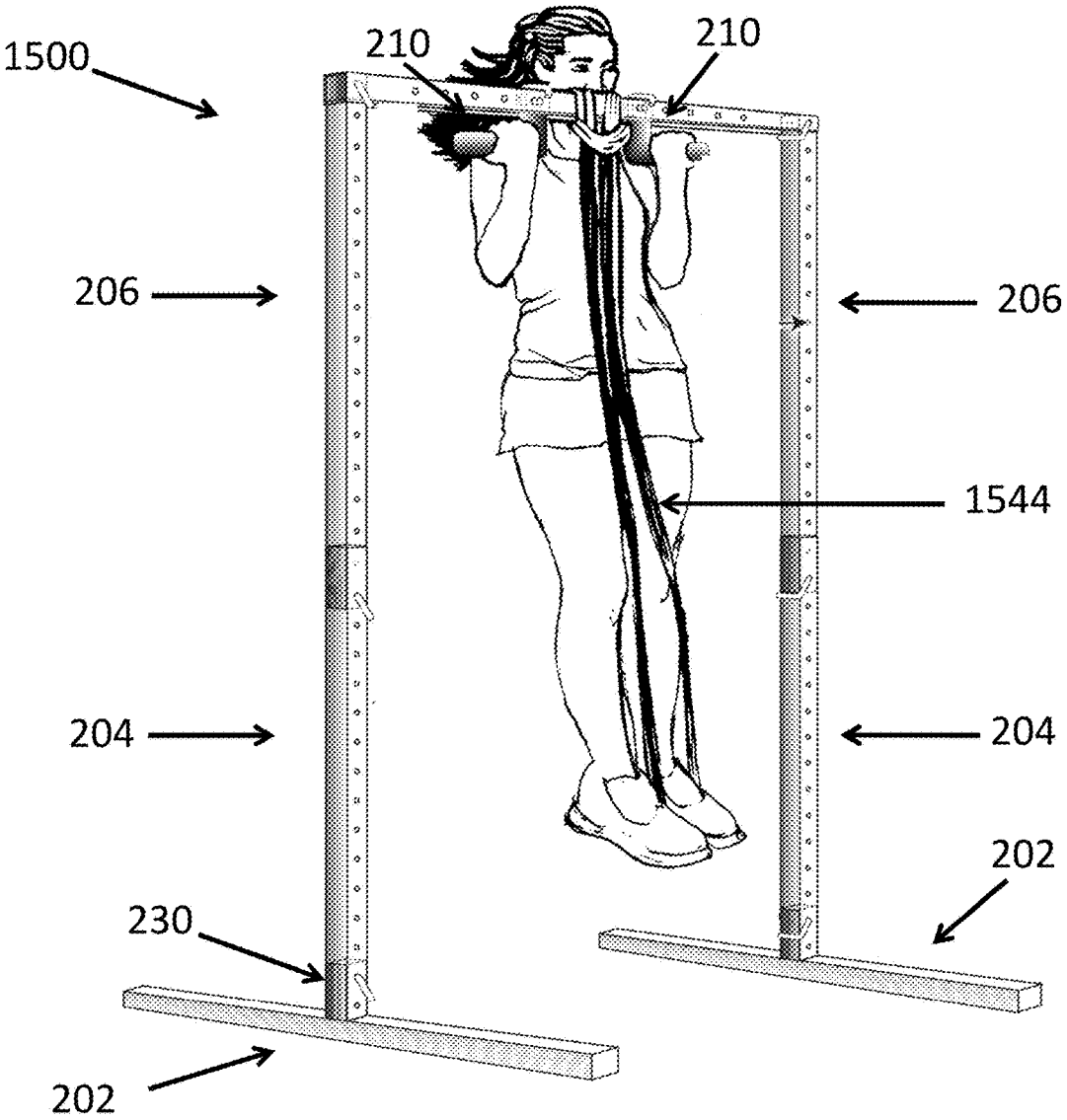
FIG. 16 is a perspective view of multifunction exercise equipment as per an aspect of an embodiment of the present invention.

FIGS. 15-16 are perspectives view of multifunction exercise equipment 1500 as per an aspect of an embodiment of the present invention. Multifunction exercise equipment 1500 may comprise first and second bases 202 which stabilize the multifunction exercise equipment 1500. The first base 202 may be configured to slidably engage the first portion 204 of the first leg, and the second base 202 may be configured to slidably engage the first portion 204 of the second leg. The second portion 206 of the first leg may be configured to slidably engage the first portion 204 of the first leg, and the second portion 206 of the second leg may be configured to slidably engage the first portion 204 of the second leg. A first end portion of the crossbar 208 may be configured to slidably engage the second portion 206 of the first leg, and a second end portion of the crossbar 208 may be configured to slidably engage the second portion 206 of the second leg. Handles 210 may be connected to the crossbar 208.

A resistance band 1544 may also be connected to the crossbar 210. The resistance band 1544 may be connected to the crossbar 210 by any means known in the art, such as via tying. A user may use a resistance band 1544 and the multifunction exercise equipment 1500 to perform exercises. For example, the user shown in FIGS. 15-16 may use the resistance band 1544 to aid in pull-up exercises. In FIG. 15, the user may be preparing to pull herself up. The resistance band 1544 may provide additional upward force, thereby mitigating the upward force that the user must supply to pull herself up. In FIG. 16, the user may have successfully pulled herself up with the help of the resistance band.

A user may use the exercise equipment illustrated in FIGS. 13-16 to perform a variety of exercises, including squats, military presses, squat jumps, and calf raises.

Figure 17:
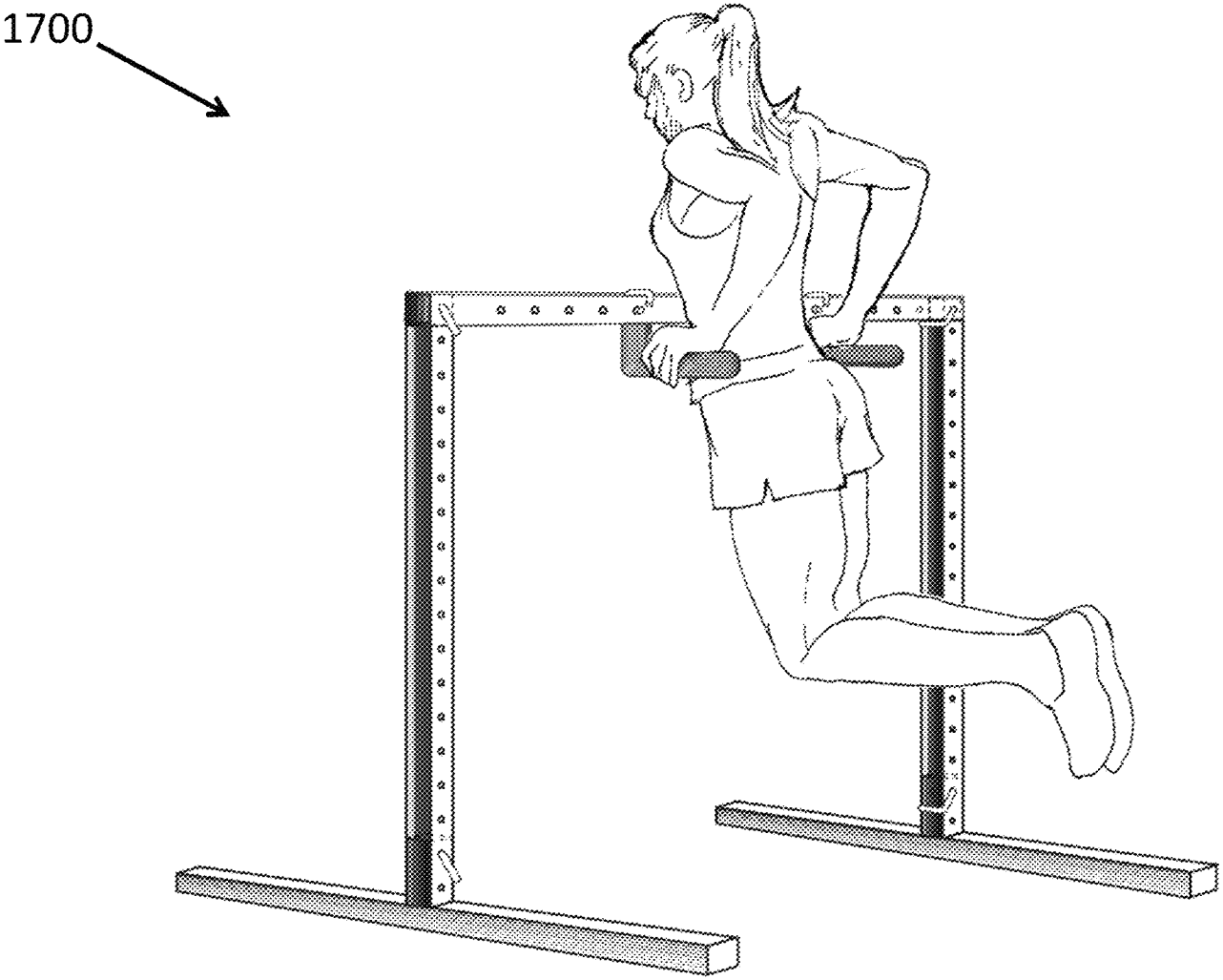
FIG. 17 is a perspective view of multifunction exercise equipment as per an aspect of an embodiment of the present invention.

FIG. 17 is a perspective view of multifunction exercise equipment 1700 as per an aspect of an embodiment of the present invention. FIG. 17 illustrates a further embodiment to provide a user with additional exercise options. For example, the user in FIG. 17 may be doing dip exercises. A user may also use multifunction exercise equipment 1700 to perform a variety of other exercises, including reverse push-ups, inverted rows, tuck-back lever pull-ups, leg raises, and leg tuck and twists.

Figure 18:
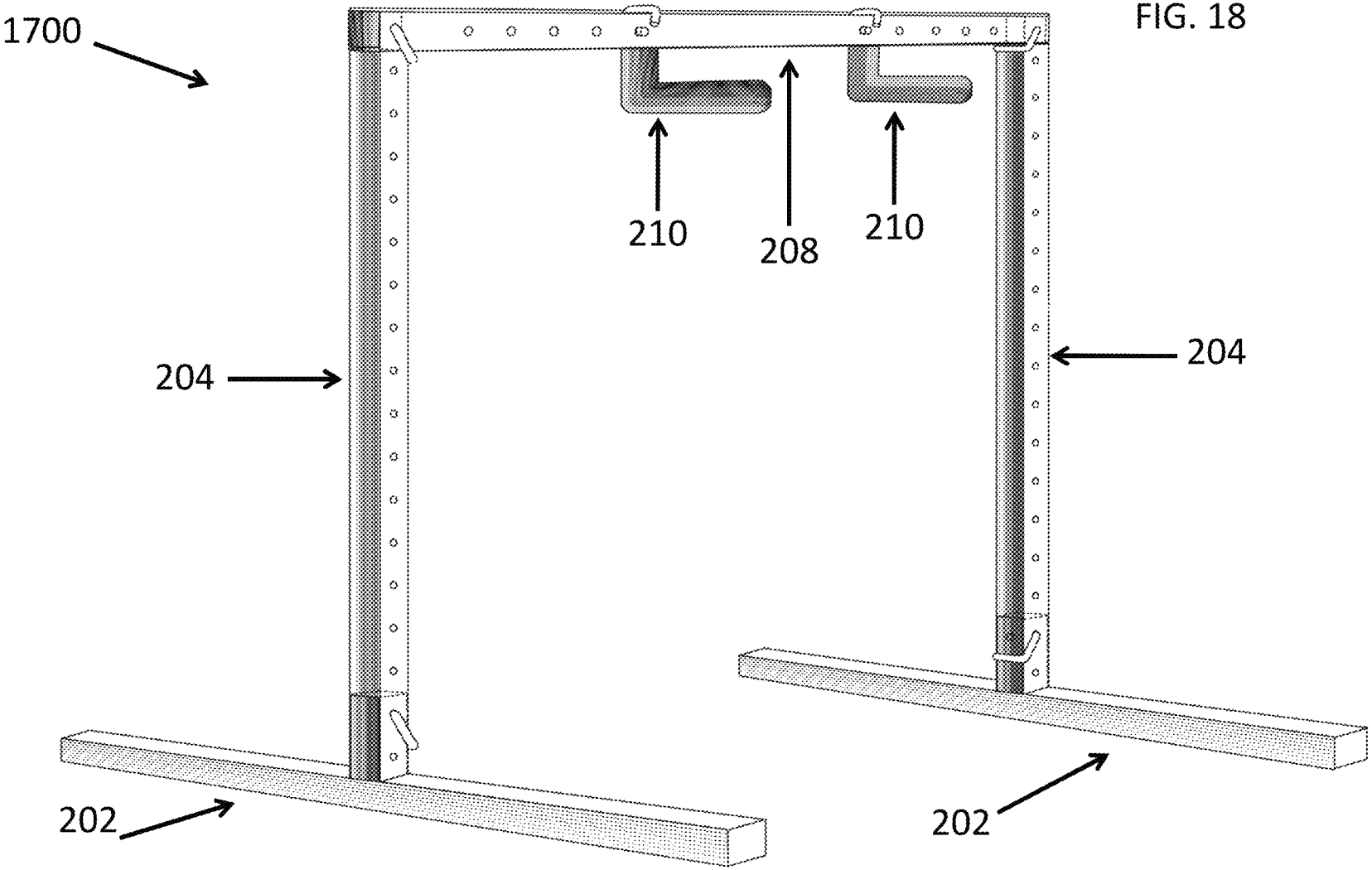
FIG. 18 is a perspective view of multifunction exercise equipment as per an aspect of an embodiment of the present invention.

FIG. 18 is a perspective view of multifunction exercise equipment 1700 as per an aspect of an embodiment of the present invention. Multifunction exercise equipment 1700 may comprise first and second bases 202 which stabilize the multifunction exercise equipment 1700. The first base 202 may be configured to slidably engage the first portion 204 of the first leg, and the second base 202 may be configured to slidably engage the first portion 204 of the second leg. The second portion of the first leg may be configured to slidably engage the first portion 204 of the first leg, and the second portion of the second leg may be configured to slidably engage the first portion 204 of the second leg. A first end portion of the crossbar 208 may be configured to slidably engage the second portion of the first leg, and a second end portion of the crossbar 208 may be configured to slidably engage the second portion of the second leg. Handles 210 may be connected to the crossbar 208. In this embodiment, the second portions of the first and second legs may be slidably disposed such that only the segment of the second portions which extend into the end portion of the crossbar 208 extend beyond the first portions 204 of the first and second legs. Thus, the second portions of the legs may be almost entirely slid into the first portion 204 of the legs, which may be why the second portions of the legs are not visible in FIG. 18.

In an embodiment, a similar configuration may be arranged by leaving the second portions 206 of the first and second legs at least partially extended and sliding the crossbar 208 along the extended section of the second portion 206 of the first and second legs, such that a segment of the second portion 206 extends through the crossbar 208, such as section A as illustrated in FIG. 7.

Figure 19:
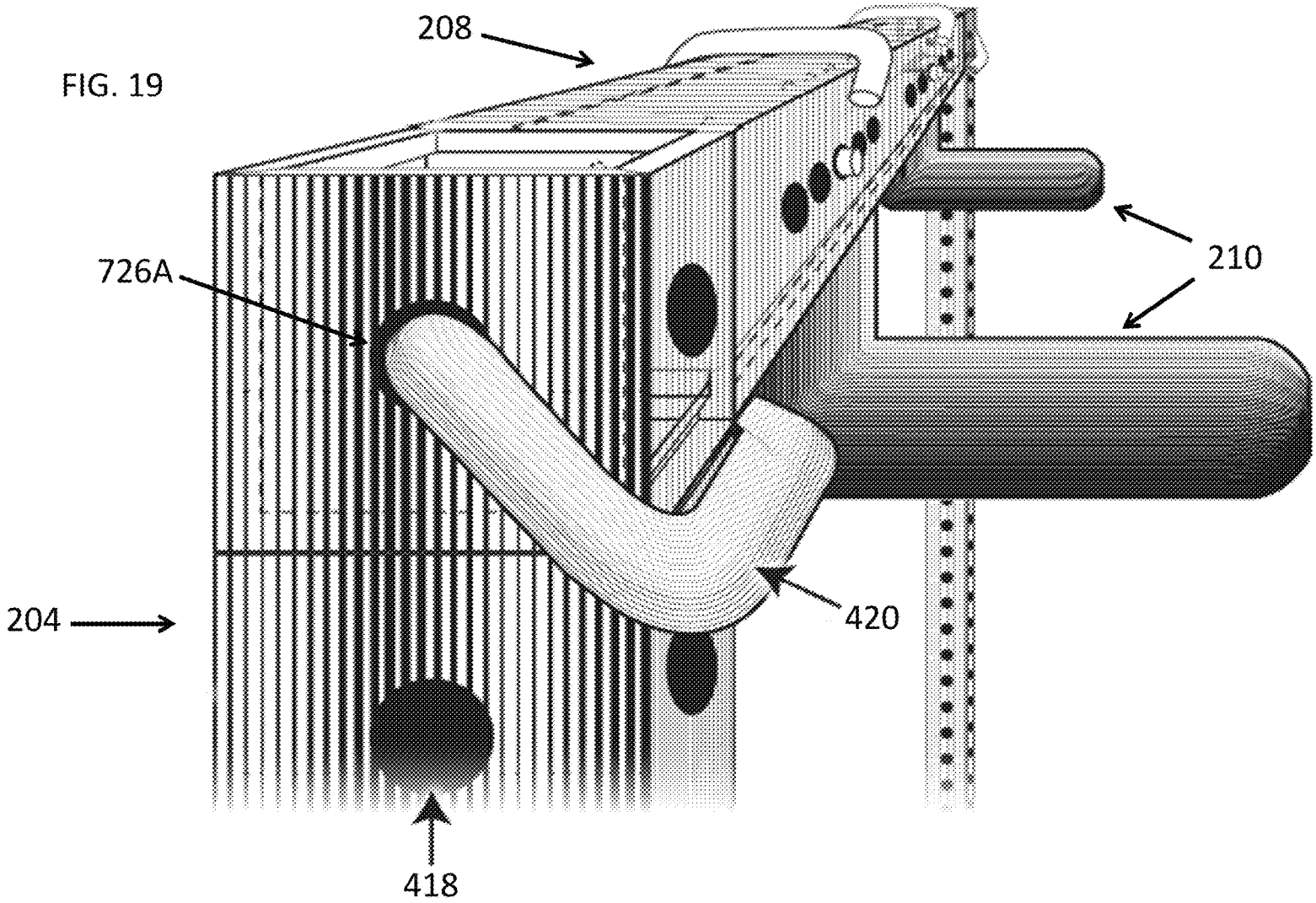
FIG. 19 is a partial view of multifunction exercise equipment as per an aspect of an embodiment of the present invention.

FIG. 19 is a partial view of multifunction exercise equipment 1700 as per an aspect of an embodiment of the present invention. In particular, FIG. 19 illustrates the crossbar 208 and first portion 204 of the first leg. The second portion of the first leg may be configured to slidably engage the first portion 204 of the first leg, and the second portion of the second leg may be configured to slidably engage the first portion 204 of the second leg. The first portion 204 of the first or second legs may comprise a surface defining holes 418.

A first end portion of the crossbar 208 may be configured to slidably engage the second portion of the first leg via hole 726A and connector 420, as illustrated in FIGS. 7-9. Handles 210 may be connected to the crossbar 208. In this embodiment, the second portions of the first and second legs may be slidably disposed such that only the segment of the second portions which extend into the end portion of the crossbar 208 extend beyond the first portions 204 of the first and second legs. Thus, the second portions of the legs may be almost entirely slid into the first portion 204 of the legs, which may be why the second portions of the legs are not visible in FIG. 19. As illustrated in FIG. 19, the end portion of the crossbar 208 may contact the first portion 204. In an embodiment, the perimeter dimensions of the end portion of the crossbar 208 may be equal to the perimeter dimensions of the first portion 204. In an embodiment, the perimeter dimensions of the crossbar may be greater than those of the first and second portions of the first and second legs, such that the first and/or second portions may extend through the crossbar. In an embodiment, the crossbar may extend into the first and/or second portions. In an embodiment, section A may comprise a cover which prevents the second portion 206 from extending through the crossbar 208.

Figure 20:
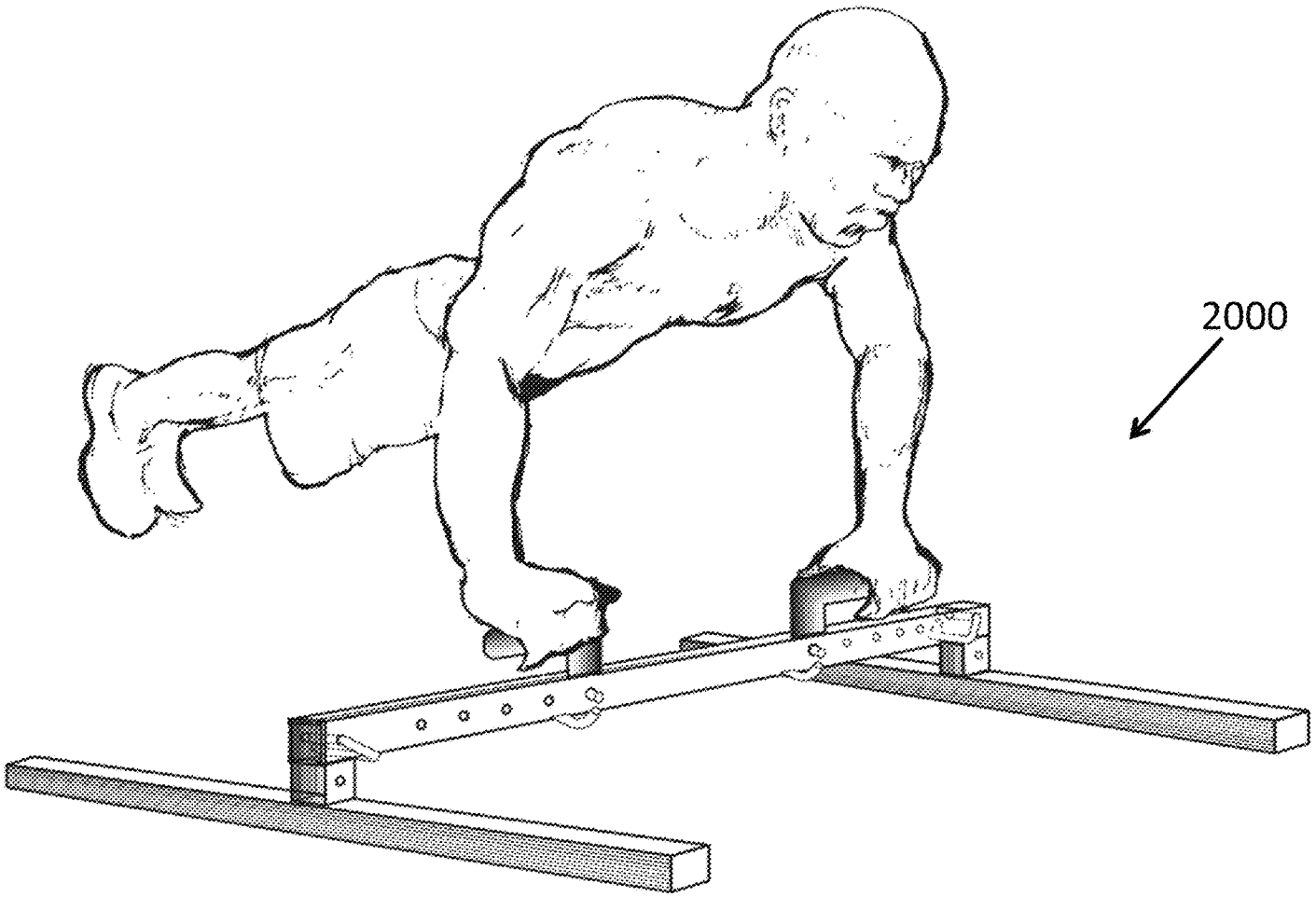
FIG. 20 is a perspective view of multifunction exercise equipment as per an aspect of an embodiment of the present invention.

FIG. 20 is a perspective view of multifunction exercise equipment 2000 as per an aspect of an embodiment of the present invention. FIG. 20 illustrates a further embodiment to provide a user with additional exercise options. For example, the user in FIG. 20 may be doing push up exercises. A user may also use multifunction exercise equipment 2000 to perform a variety of other exercises, including planks, handstands, handstand push-ups, one-legged push-ups, spider push-ups, seated leg raises, seated knee raises, sit-ups, crunches, and reverse push-ups.

Figure 21:
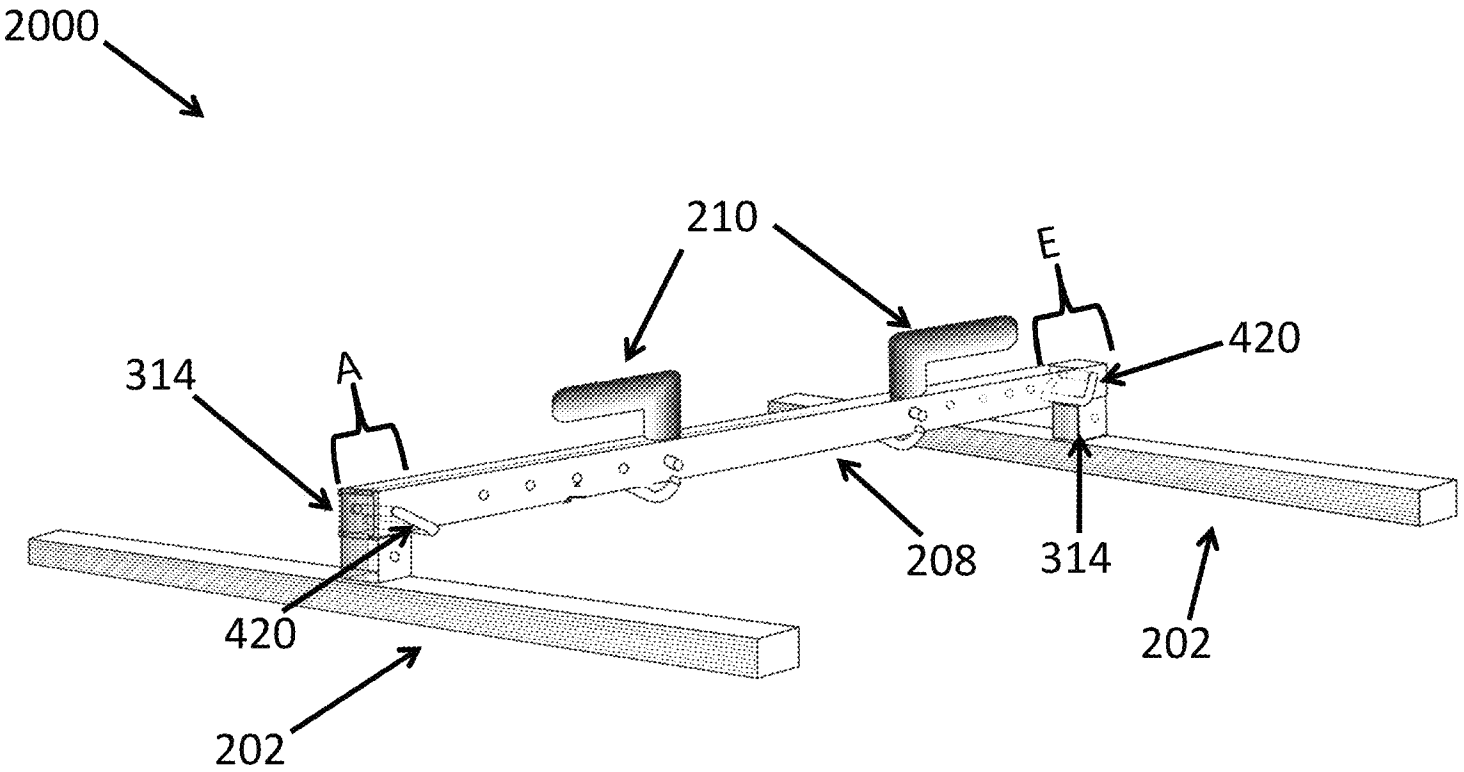
FIG. 21 is a perspective view of multifunction exercise equipment as per an aspect of an embodiment of the present invention.

FIG. 21 is a perspective view of multifunction exercise equipment as per an aspect of an embodiment of the present invention. Multifunction exercise equipment 2000 may comprise first and second bases 202 which stabilize the multifunction exercise equipment 2000. The first base 202 may comprise a base extension 314 which is configured to slidably engage section A of the crossbar 208, and the second base 202 may comprise a base extension 314 which is configured to slidably engage section E of the crossbar 208. The crossbar 208 may comprise a hollow columnar structure which defines a space for the base extension 314. The base extension 314 may be slidably engaged with the crossbar 208 such that holes in the base extension align with holes in sections A and E. A connector, such as pin 420, may pass through the holes in section A and the holes in the base extension 314. Another connector, such as pin 420, may pass through the holes in section E and the holes in the base extension 314. Pins 420 may thus secure the crossbar 208 to the base extensions. Handles 210 may be connected to the crossbar 208.

In an embodiment, the crossbar may be oriented up-side-down relative to its orientation as illustrated in FIG. 2. In this embodiment, the crossbar 208 may comprise a track which fixes the handles in a single direction relative to the handle (e.g., downward in FIG. 2). In an embodiment, the crossbar may be oriented in the same manner as illustrated in FIG. 2. In this embodiment, the crossbar 208 may not comprise a track and the handles may be removable from the crossbar 208. For example, a user may remove the handles from the downward direction as illustrated in FIG. 2 and inserted from the opposite (i.e., topward) direction. In an embodiment, the multifunction exercise equipment as illustrated in FIG. 21 may further comprise first and second legs which extend through the crossbar.

Various elements of the multifunction exercise equipment may comprise any material which is suitable for use as multifunction exercise equipment. For example, the base, stabilizer bar (if present), first and second legs, and/or crossbar may comprise 11- or 12-gauge steel, titanium, and/or plastic. Further, one or more handles and/or connectors may comprise high-grade aluminum, steel, titanium, or plastic. Various elements of the multifunction exercise equipment may further comprise a finish. In an embodiment, the finish may be a rust proof black powder coat finish which is applied via spray paint to the base, stabilizer bar (if present), first and second legs, and/or crossbar. In an embodiment, a handle may comprise a rubber or foam covering to facilitate a user's grip. In an embodiment, the base and/or stabilizer bar may further comprise one or more round felt and/or rubber pieces which separate the base and/or stabilizer bar from the ground.

While various embodiments have been described above, it should be understood that they have been presented by way of example, and not limitation. It will be apparent to persons skilled in the relevant art(s) that various changes in form and detail can be made therein without departing from the spirit and scope. In fact, after reading the above description, it will be apparent to one skilled in the relevant art(s) how to implement alternative embodiments. Thus, the present embodiments should not be limited by any of the above described exemplary embodiments.

In addition, it should be understood that the figures, which highlight the functionality and advantages of the present invention, are presented for example purposes only. The architecture of the present invention is sufficiently flexible and configurable, such that it may be utilized in ways other than that shown in the accompanying figures.

It should be noted the terms "including" and "comprising" should be interpreted as meaning "including, but not limited to".

In this specification, "a" and "an" and similar phrases are to be interpreted as "at least one" and "one or more." References to "the," "said," and similar phrases should be interpreted as "the at least one", "said at least one", etc. References to "an" embodiment in this disclosure are not necessarily to the same embodiment.

It is the applicant's intent that only claims that include the express language "means for" or "step for" be interpreted under 35 U.S.C. § 112(f). Claims that do not expressly include the phrase "means for" or "step for" are not to be interpreted under 35 U.S.C. § 112(f).

The disclosure of this patent document incorporates material which is subject to copyright protection. The copyright owner has no objection to the facsimile reproduction by anyone of the patent document or the patent disclosure, as it appears in the Patent and Trademark Office patent file or records, for the limited purposes required by law, but otherwise reserves all copyright rights whatsoever.

Further, the purpose of the Abstract of the Disclosure is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract of the Disclosure is not intended to be limiting as to the scope in any way.

What is claimed is:

1. An apparatus comprising:

a crossbar including a surface with holes arranged along a first portion of the crossbar;

a first handle including a surface with a hole, wherein the crossbar is configured to allow the first handle to positionally adjust along the first portion of the crossbar such that the hole in the surface of the first handle aligns with one of the holes in the surface of the crossbar when the first handle is located at a position along the first portion; and a first connector passing through the hole in the surface of the first handle and one of the holes in the surface of the crossbar at the position along the first portion, wherein:

the first handle further comprises:

a head upon which the hole in the surface of the first handle is disposed; and a body connected to the head;

the crossbar further comprises:

a first wall;

a first lip protruding from the first wall;

a second wall parallel to the first wall; and a second lip protruding from the second wall, wherein the first lip and the second lip protrude toward each other;

the head of the first handle is configured to slide along a track formed by the first lip and the second lip, wherein the body of the first handle extends beyond the first lip and the second lip; and the head of the first handle defines a hollow section comprising:

the surface of the first handle; and a second hole on a portion of the hollow section opposite the surface, the second hole being aligned with the hole in the surface of the first handle.

2. The apparatus of claim 1, further comprising a base, wherein the base comprises a base extension configured to slidably engage an end portion of the crossbar or a first portion of a first leg such that a hole in the base extension aligns with a hole in the end portion of the crossbar or a hole in the first portion of the first leg when the end portion of the crossbar or the first portion of the first leg is located at a position along the base extension.

3. The apparatus of claim 2, wherein an end portion of the crossbar is configured to allow a second portion of the first leg to slidably engage the end portion of the crossbar such that the hole in the end portion of the crossbar aligns with one of the holes in the second portion of the first leg when the second portion of the first leg is located at a position along the end portion of the crossbar.

4. The apparatus of claim 3, further comprising a fourth connector passing through one of the holes in the second portion of the first leg and the hole in the end portion of the crossbar at the position along the end portion of the crossbar.

5. The apparatus of claim 4, wherein the first and fourth connectors are interchangeable.

6. The apparatus of claim 2, wherein:

the base extension slidably engages the first portion of the first leg, wherein the first portion of the first leg comprises:

a hollow columnar shape; and a surface of the first portion of the leg which defines holes arranged along a segment of the first portion of the first leg;

the apparatus further comprises a surface of a second portion of the first leg which defines holes arranged along a segment of the second portion of the first leg; and the first portion of the first leg is configured to allow the second portion of the first leg to slide along the segment of the first portion of the first leg such that one of the holes in the second portion of the first leg aligns with one of the holes in the first portion of the first leg when the first portion of the first leg is located at a position along the second portion of the first leg.

7. The apparatus of claim 6, further comprising a fifth connector passing through one of the holes in the first portion of the first leg and one of the holes in the second portion of the first leg.

8. The apparatus of claim 7, wherein the first and fifth connectors are interchangeable.

9. The apparatus of claim 2, further comprising a third connector passing through the hole in the end portion of the crossbar or the hole in the first portion of the first leg and the hole in the base extension at the position along the base extension.

10. The apparatus of claim 9, wherein the first and third connectors are interchangeable.

11. The apparatus of claim 2, further comprising a second base, wherein the second base comprises a second base extension configured to slidably engage a second end portion of the crossbar or a first portion of a second leg such that a hole in the second base extension aligns with a hole in the second end portion of the crossbar or a hole in the first portion of the second leg when the second end portion of the crossbar or the first portion of the second leg is located at a position along the second base extension.

12. The apparatus of claim 11, further comprising a stabilizer bar connecting the base and the second base.

13. The apparatus of claim 2, wherein the second portion of the first leg is slidably disposed such that only a segment of the second portion of the first leg which extends into the end portion of the crossbar extends beyond the first portion of the first leg.

14. The apparatus of claim 2, further comprising a J-hook secured to the second portion of the first leg.

15. The apparatus of claim 2, further comprising a resistance band secured to the crossbar.

16. The apparatus of claim 1, further comprising:

an end portion of the crossbar configured to slidably engage a second portion of a first leg which defines holes arranged along a segment of the second portion of the first leg such that a hole in the end portion of the crossbar aligns with one of the holes in the second portion of the first leg when the second portion of the first leg is located at a position along the end portion of the crossbar;

a second end portion of the crossbar configured to slidably engage a second portion of a second leg which defines holes arranged along a segment of the second portion of the second leg such that a hole in the second end portion of the crossbar aligns with one of the holes in the second portion of the second leg when the second portion of the second leg is located at a position along the second end portion of the crossbar;

a first portion of the first leg which defines holes arranged along a segment of the first portion of the first leg, the first portion of the first leg configured to slidably engage the second portion of the first leg to slide such that one of the holes in the second portion of the first leg aligns with one of the holes in the first portion of the leg when the second portion of the first leg is located at a position along the first portion of the first leg;

a second portion of the second leg which defines holes arranged along a segment of the second portion of the second leg, the second portion of the second leg configured to slidably engage the segment of the first portion of the second leg such that one of the holes in the second portion of the second leg aligns with one of the holes in the first portion of the second leg when the second portion of the second leg is located at a position along the first portion of the second leg;

a base comprising a base extension configured to slidably engage the first portion of the first leg such that a hole in the base extension aligns with a hole in the first portion of the first leg when the end portion of the crossbar or the second portion of the first leg is located at a position along the base extension;

a second base comprising a second base extension configured to slidably engage the second portion of the second leg such that a hole in the second base extension aligns with a hole in the first portion of the second leg when the first portion of the second leg is located at a position along the second base extension.

17. The apparatus of claim 16, further comprising a stabilizer bar connecting the base and the second base.

18. The apparatus of claim 16, wherein:

the second portion of the first leg is slidably disposed such that only a segment of the second portion of the first leg which extends into the end portion of the crossbar extends beyond the first portion of the first leg; and the second portion of the second leg is slidably disposed such that only a segment of the second portion of the second leg which extends into the end portion of the crossbar extends beyond the first portion of the second leg.

19. The apparatus of claim 16, wherein:

the second portion of the first leg is slidably disposed such that only a segment of the second portion of the first leg slidably engaged with the first portion of the first leg; and the second portion of the second leg is slidably disposed such that only a segment of the second portion of the second leg slidably engaged with the first portion of the second leg.

20. The apparatus of claim 1, wherein the surface of the crossbar includes a second portion defining holes therein, the apparatus further comprising:

a second handle including a surface with a hole, wherein the crossbar is configured to allow the second handle to positionally adjust along the second portion of the crossbar such that the hole in the surface of the second handle aligns with one of the holes in the surface of the crossbar when the second handle is located at a position along the second portion; and a second connector passing through the hole in the surface of the second handle and one of the holes in the surface of the crossbar at the position along the second portion.

21. The apparatus of claim 20, wherein the first and second connectors are interchangeable.

22. The apparatus of claim 1, further comprising:

a base comprising a base extension configured to accept an end portion of the crossbar such that a hole in the base extension aligns with a hole in the end portion of the crossbar when the end portion of the crossbar is located at a position along the base extension; and a second base comprising a second base extension configured to accept a second end portion of the crossbar such that a hole in the second base extension aligns with a hole in the second end portion of the crossbar when the second end portion of the crossbar is located at a position along the second base extension.

23. The apparatus of claim 22, further comprising a stabilizer bar connecting the base and the second base.

24. The apparatus of claim 1, wherein:

the first handle is configured to orient relative to the crossbar such that the hole in the first handle aligns with the holes in the crossbar; and the apparatus further comprising a sixth connector passing through the hole in the first handle at the orientation relative to the crossbar.

25. The apparatus of claim 24, wherein the first connector and the sixth connector have the same construction.

26. The apparatus of claim 1, wherein the first wall and the second wall comprise the surface of the crossbar, wherein the holes in the surface of the crossbar are mutually aligned across the first wall and the second wall.

27. The apparatus of claim 1, wherein the crossbar is configured to allow the first handle to positionally adjust from the position along the first portion to a second position along the first portion, wherein the hole in the first handle aligns with another of the holes in the crossbar at the second position.

28. The apparatus of claim 1, wherein the first connector is employed to connect the first handle in a second position along the first portion.

29. The apparatus of claim 1, wherein the connector comprises a pin.

30. An apparatus comprising:

a crossbar defining a hole therein;

a first handle comprising a first head which defines a plurality of holes; and a first connector configured to slidably engage one of the plurality of holes in the first handle and the hole in the crossbar, each of the plurality of holes in the first handle defining an orientation of the first handle wherein:

the plurality of holes comprises pairs of holes, wherein each of the pairs of holes is on opposite sides of a head of the first handle; and the head of the first handle is configured to rotate within the crossbar.

31. The apparatus of claim 30, further comprising a base, wherein the base comprises a base extension configured to slidably engage an end portion of the crossbar or a first portion of a first leg such that a hole in the base extension aligns with a hole in the end portion of the crossbar or a hole in the first portion of the first leg when the end portion of the crossbar or the first portion of the first leg is located at a position along the base extension; and a third connection configured to slidably engage the hole in the base extension and the hole in the end portion of the crossbar or a hole in the first portion of the first leg.

32. The apparatus of claim 31, wherein an end portion of the crossbar is configured to slidably engage a second portion of the first leg such that the hole in the end portion of the crossbar aligns with one of the holes in the second portion of the first leg when the second portion of the first leg is located at a position along the end portion of the crossbar.

33. The apparatus of claim 32, further comprising a fourth connector passing through one of the holes in the second portion of the first leg and the hole in the end portion of the crossbar at the position along the end portion of the crossbar.

34. The apparatus of claim 33, wherein the first and fourth connectors are interchangeable.

35. The apparatus of claim 31, wherein:

the base extension slidably engages the first portion of the first leg, wherein the first portion of the first leg comprises:

a hollow columnar shape; and a surface of the first portion of the leg which defines holes arranged along a segment of the first portion of the first leg;

the apparatus further comprises a surface of a second portion of the first leg which defines holes arranged along a segment of the second portion of the first leg; and the first portion of the first leg is configured to allow the second portion of the first leg to slide along the segment of the first portion of the first leg such that one of the holes in the second portion of the first leg aligns with one of the holes in the first portion of the first leg when the first portion of the first leg is located at a position along the second portion of the first leg.

36. The apparatus of claim 35, further comprising a fifth connector passing through one of the holes in the first portion of the first leg and one of the holes in the second portion of the first leg.

37. The apparatus of claim 36, wherein the first and fifth connectors are interchangeable.

38. The apparatus of claim 31, wherein the first and third connectors are interchangeable.

39. The apparatus of claim 38, further comprising a stabilizer bar connecting the base and the second base.

40. The apparatus of claim 31, wherein the second portion of the first leg is slidably disposed such that only a segment of the second portion of the first leg which extends into the end portion of the crossbar extends beyond the first portion of the first leg.

41. The apparatus of claim 31, further comprising a J-hook secured to the second portion of the first leg.

42. The apparatus of claim 31, further comprising a resistance band secured to the crossbar.

43. The apparatus of claim 31, further comprising a second base, wherein the second base comprises a second base extension configured to slidably engage a second end portion of the crossbar or a first portion of a second leg such that a hole in the second base extension aligns with a hole in the second end portion of the crossbar or a hole in the first portion of the second leg when the second end portion of the crossbar or the first portion of the second leg is located at a position along the second base extension.

44. The apparatus of claim 30, further comprising:

an end portion of the crossbar configured to slidably engage a second portion of a first leg which defines holes arranged along a segment of the second portion of the first leg such that a hole in the end portion of the crossbar aligns with one of the holes in the second portion of the first leg when the second portion of the first leg is located at a position along the end portion of the crossbar;

a second end portion of the crossbar configured to slidably engage a second portion of a second leg which defines holes arranged along a segment of the second portion of the second leg such that a hole in the second end portion of the crossbar aligns with one of the holes in the second portion of the second leg when the second portion of the second leg is located at a position along the second end portion of the crossbar;

a first portion of the first leg which defines holes arranged along a segment of the first portion of the first leg, the first portion of the first leg configured to slidably engage the second portion of the first leg to slide such that one of the holes in the second portion of the first leg aligns with one of the holes in the first portion of the first leg when the second portion of the first leg is located at a position along the first portion of the first leg;

a second portion of the second leg which defines holes arranged along a segment of the second portion of the second leg, the second portion of the second leg configured to slidably engage the segment of the first portion of the second leg such that one of the holes in the second portion of the second leg aligns with one of the holes in the first portion of the second leg when the second portion of the second leg is located at a position along the first portion of the second leg;

a base comprising a base extension configured to slidably engage the first portion of the first leg such that a hole in the base extension aligns with a hole in the first portion of the first leg when the end portion of the crossbar or the second portion of the first leg is located at a position along the base extension;

a second base comprising a second base extension configured to slidably engage the second portion of the second leg such that a hole in the second base extension aligns with a hole in the first portion of the second leg when the first portion of the second leg is located at a position along the second base extension.

45. The apparatus of claim 44, further comprising a stabilizer bar connecting the base and the second base.

46. The apparatus of claim 44, wherein:

the second portion of the first leg is slidably disposed such that only a segment of the second portion of the first leg which extends into the end portion of the crossbar extends beyond the first portion of the first leg; and the second portion of the second leg is slidably disposed such that only a segment of the second portion of the second leg which extends into the end portion of the crossbar extends beyond the first portion of the second leg.

47. The apparatus of claim 44, wherein:

the second portion of the first leg is slidably disposed such that only a segment of the second portion of the first leg slidably engaged with the first portion of the first leg; and the second portion of the second leg is slidably disposed such that only a segment of the second portion of the second leg slidably engaged with the first portion of the second leg.

48. The apparatus of claim 30, wherein the head of the handle is configured to rotate when the head of the handle is removed from the crossbar.

49. The apparatus of claim 48, wherein the crossbar further comprises:

a first wall; and a second wall parallel to the first wall, wherein a width of the head is similar to a distance between the first wall and the second wall.

50. The apparatus of claim 30, further comprising a second handle comprising a second head which defines a plurality of holes in the second handle; and a second connector configured to slidably engage one of the plurality of holes in the second handle and the hole in the crossbar, each of the plurality of holes in the second handle defining an orientation of the second handle.

51. The apparatus of claim 50, wherein the first and second connectors are interchangeable.

52. The apparatus of claim 30, further comprising:

a base comprising a base extension configured to accept an end portion of the crossbar such that a hole in the base extension aligns with a hole in the end portion of the crossbar when the end portion of the crossbar is located at a position along the base extension; and a second base comprising a second base extension configured to accept a second end portion of the crossbar such that a hole in the second base extension aligns with a hole in the second end portion of the crossbar when the second end portion of the crossbar is located at a position along the second base extension.

53. The apparatus of claim 52, further comprising a stabilizer bar connecting the base and the second base.

54. The apparatus of claim 30, wherein the first connector is employed to secure the first handle at a second orientation.

55. The apparatus of claim 30, wherein the head of the first handle comprises an octagonal columnar structure.

56. The apparatus of claim 30, wherein the crossbar further comprises:

a first wall; and a second wall parallel to the first wall, wherein a width of the head is smaller than a distance between the first wall and the second wall.

57. The apparatus of claim 30, wherein the connector is a pin.

* * * * *